US006120126A

United States Patent [19]

Nakahara

[11] Patent Number: 6,120,126

[45] Date of Patent: Sep. 19, 2000

[54] INK JET PRINTER

[75] Inventor: Junji Nakahara, Nagoya, Japan

[73] Assignee: Brother Kogyo Kabushiki Kaisha, Nagoya, Japan

[21] Appl. No.: 09/039,208

[22] Filed: Mar. 16, 1998

[30] Foreign Application Priority Data

| | | | |
|---|---|---|---|
| Mar. 18, 1997 | [JP] | Japan | 9-064085 |
| Mar. 19, 1997 | [JP] | Japan | 9-065852 |
| Mar. 19, 1997 | [JP] | Japan | 9-065853 |

[51] Int. Cl.[7] ..... B41J 2/165

[52] U.S. Cl. ..... 347/23; 347/29

[58] Field of Search ..... 347/23, 29, 32; 417/53

[56] References Cited

U.S. PATENT DOCUMENTS

| | | | |
|---|---|---|---|
| 5,475,404 | 12/1995 | Takahashi et al. | 347/23 |
| 5,639,220 | 6/1997 | Hayakawa | 417/53 |
| 5,828,389 | 10/1998 | Yamaguchi et al. | 347/23 |
| 5,852,452 | 12/1998 | Imai | 347/8 |

FOREIGN PATENT DOCUMENTS

| | | |
|---|---|---|
| 0 525 988 | 2/1993 | European Pat. Off. . |
| 0 540 174 | 5/1993 | European Pat. Off. . |
| 0 559 122 | 9/1993 | European Pat. Off. . |
| 0 615 846 | 9/1994 | European Pat. Off. . |
| 0 694 404 | 1/1996 | European Pat. Off. . |
| 0 698 495 | 2/1996 | European Pat. Off. . |
| 0 701 061 | 3/1996 | European Pat. Off. . |
| 63-224960 | 9/1988 | Japan . |
| 3-293154 | 12/1991 | Japan . |

*Primary Examiner*—N. Le
*Assistant Examiner*—Shih-wen Hsieh
*Attorney, Agent, or Firm*—Oliff & Berridge, PLC

[57] ABSTRACT

An ink jet printer includes an ink jet head having nozzles, which can be covered with a suction cap. A pump can suck ink out of the head to purge it. A controller can vary the suction pressure or the suction cycle period of the pump in accordance with a purge mode. Automatic purges can be performed at predetermined time intervals for the maintenance of the printer. A manual purge can be performed for recovery from defective ejection of ink from the head. Another purge can be performed just after an ink cartridge is replaced for the printer. The controller controls the pump in such a manner that at least one of the automatic purges, the manual purge and the purge after cartridge replacement differ from each other in at least one of the suction period and pressure. Depending on the using condition of the printer, it is possible to prevent defective ejection of ink due to the clogging of the nozzles and/or the bubbling of ink.

27 Claims, 22 Drawing Sheets

INK JET PRINTER

BACKGROUND OF THE INVENTION

1. Field of the Invention

The present invention relates to a recovery apparatus for an ink jet printer for recording by ejecting ink onto a recording medium.

2. Description of Related Art

A conventionally known ink jet printer includes a recording head for recording by ejecting ink onto a recording medium. The printer also includes a pumping means having a suction cap for contact with a surface of the head on which nozzles are formed. The pumping means can suck ink from the head through the cap in contact with the nozzle formed surface. The printer further includes a control means for controlling the operation of the pumping means. The pumping means is controlled by the control means to perform a suction action. In general, this action develops a high negative pressure for suction to suck ink from the recording head in a dash through the suction cap.

For example, after an ink cartridge is connected to the recording head for the first time, or after the cartridge is replaced with a new one, the ink passage between the head and the cartridge may be filled with air. In such a case, if great suction force is applied through the suction cap, as is the case with a normal purge for recovery from defective ejection during recording operation, to suck ink from the head in a dash, a mixture of ink and air flows rapidly from the cartridge toward and into the head. The rapidly flowing ink bubbles, and consequently the ink in the ejection channels of the head contains air bubbles. In particular, this tendency is remarkable if a filter is fitted between the head and the cartridge to keep foreign substances etc. from moving together with ink toward the head. The filter may cover the ink supply hole of the cartridge. Therefore, for example, after the cartridge is replaced, it is demanded that ink be sucked from the recording head without bubbling as stated above.

On the other hand, when the ejection from the nozzles of the head is defective or bad with dry ink, foreign substances or the like blocking the nozzles, it is preferable that ink be sucked from the head in a dash with high negative pressure.

Automatic suction is performed depending on the length of the nonuse period with a timer fitted in the printer. This suction involves only removing the drying ink from the nozzles with relatively low negative pressure.

As the pump means, U.S. Pat. No. 5,639,220 of the assignee of the present applicant discloses a suction pump having a pump body provided with a suction port and a discharge port which are axially spaced, and a first piston and a second piston slidably fitted in the pump body to form a suction chamber therebetween. In a operation, a driving mechanism of the pump moves the first piston away from the second piston to expand the suction chamber so that negative pressure prevails in the suction chamber and ink is suctioned through the suction port into the suction chamber.

SUMMARY OF THE INVENTION

It is an object of the invention to provide an ink jet printer recovery apparatus which can change the form of ink suction depending on the condition of the nozzles in the recording head and/or the ink passage. In accordance with the invention, an ink jet printer is provided, which includes an ink jet head having nozzles for ejecting ink, a suction cap for covering the nozzles, and a pump for sucking ink out of the head through the cap to purge the head. The printer further includes a controller. When a purge is performed, the controller controls the pump depending on the condition of the printer to adjust at least one of the suction cycle period and the suction pressure applied to the cap.

The nozzles of the ink jet head are purged by the pump sucking ink out of them with the suction cap capping the head. When the nozzles are purged, it is possible to suitably adjust the suction cycle period or the suction pressure applied to the cap. It is therefore possible to perform a purge which is suitable for the condition of the printer, and in particular of the nozzles and/or the ink passage.

Automatic purges may be performed at predetermined time intervals for the maintenance of the printer. A manual purge may be performed for recovery from defective ejection of ink from the ink jet head. Another purge may be performed just after the replacement of an ink cartridge for the printer. The pump may be controlled in such a manner that at least one of the automatic purges, the manual purge and the purge after cartridge replacement differ from each other in at least one of the suction cycle period and the suction pressure.

For example, the controller may control the pump in such a manner that the suction pressure is lower for the automatic purges than for the manual purge. In this case, the manual purge enables the ink jet head to recover from defective ejection of ink due to the clogging of the nozzles or the like. On the other hand, the automatic purges can prevent the head from ejecting ink defectively due to the bubbling of ink. The controller may also control the pump in such a manner that, for the purge just after cartridge replacement, the suction pressure is lower than for the automatic purges. In this case, the head can be prevented from ejecting ink defectively due to the bubbling of ink just after an ink cartridge is replaced for the printer.

The purge just after cartridge replacement may involve a suction action with smaller suction force and for a shorter time than the manual and automatic purges. In this case, ink can be sucked together with the air which is present between the substituted cartridge and the ink jet head, and the ink can be prevented from bubbling there. This secures good ejection after cartridge replacement.

In particular, the purge just after cartridge replacement may involve a plurality of suction actions with small suction force and each for a short time and, thereafter, a suction action with great suction force and for a long time. The earlier actions with small suction force expel air gradually out of the ink passage, and then fill the passage with ink. The subsequent action with great suction force securely provides a good condition for starting the ejection. The pump may perform a first suction action and a second suction action which is greater in suction force and longer in suction time than the first action. The first action may be omitted during each of the automatic and manual purges. This can prevent ink from being wasted during the automatic and manual purges, and shorten the purge time.

The printer may also include a memory storing various suction modes, which are combinations of suction pressures and suction cycle periods. In this case, when a purge is performed, the controller may select the suction mode depending on the printer condition. In accordance with the selected mode, the controller may operate the pump.

The printer may further include a switch for performing the operator's manual purge, a timer, and/or a sensor for detecting the replacement of an ink cartridge. The suction modes may include a mode of performing the manual purge on the basis of the operator's switching operation, a mode of performing automatic purges at time intervals predetermined by the timer, and/or a mode of performing a purge just after replacement of an ink cartridge in accordance with a detection signal from the sensor.

The pump may include a pump body, which has a suction port and a discharge port both formed in it. The pump may also include a pair of pistons, which can slide in the body, and which define a pump chamber between them in the body. At least one of the pistons can close and open at least one of the ports when the one of the pistons slides. A cam may be connected to the pistons to drive them.

The movement of the pistons may be controlled to vary the volume of the pump chamber between them, adjusting the suction pressure and/or the suction cycle period. For example, the suction pressure and/or the suction cycle period may be adjusted by moving the pistons continuously without stopping them, or by moving the pistons intermittently, with the suction port open. This intermittent movement may include stopping temporarily and then moving again. Otherwise, the suction pressure and/or the suction cycle period may be adjusted by varying the cycle period of the intermittent movement, or by adjusting the time for which the pistons stop.

The cam may have cam grooves of predetermined patterns. The grooves may each engage with a cam follower, which may be connected to one of the pistons. The grooves may have profiles for driving the pistons independently of each other. This can achieve complex suction patterns, in each of which the suction form varies with the turning angle of the single cam. The suction port may be opened a plurality of times during one turn of the cam. While the suction port is open, the cam may be turned continuously or intermittently to move the pistons continuously or intermittently, thereby adjusting the suction pressure and/or the suction cycle period. By thus adjusting the turning and the stopping of the cam, it is possible to make the suction pressure variable without varying the turning speed of the cam, that is to say, without using a varying-speed motor, which is complicated and expensive. However, the turning speed of the cam might be adjusted to produce various suction modes.

The suction cap may include a member having a cam follower for engagement with the cam. The cam can, through the member, move the suction cap toward and away from the ink jet head. This can make common the drive sources for the cap and the pump to make the printer small. In this case, by adjusting the position of the cap relative to the head and the suction timing, it is possible to suck ink together with air, with the cap separated partially from the surface of the head in which the nozzles are formed. This can suck and remove the ink remaining in the cap.

BRIEF DESCRIPTION OF THE DRAWINGS

Preferred embodiments of the invention are shown in the accompanying drawings, in which.

DETAILED DESCRIPTION OF PREFERRED EMBODIMENTS

Figure 1:
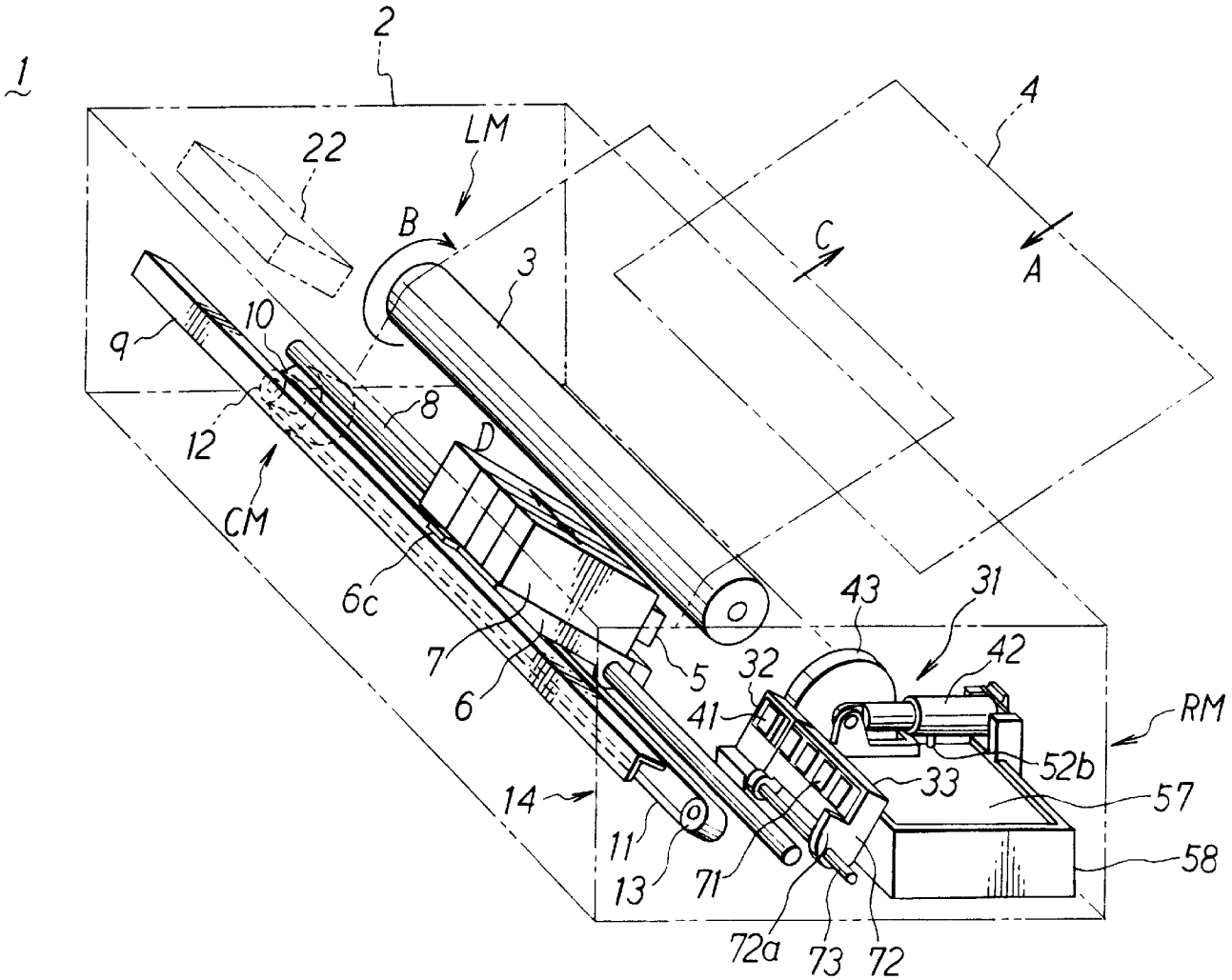
FIG. 1 is a schematic perspective view of an ink jet printer according to the invention.

With reference to FIG. 1, an ink jet printer 1 according to the invention includes a frame 2, a sheet cassette (not shown) or a manual feed port (not shown) and a sheet outlet (not shown). A sheet feed mechanism LM includes a cylindrical platen roller 3 supported rotatably by the frame 2 through a horizontal shaft (not shown). A printing sheet or recording medium 4 can be fed from the cassette or the feed port, and moved under an ink jet type recording head 5 by the roller 3. The head 5 has nozzles for ejecting droplets of ink onto the sheet 4 to print it. The feed mechanism LM also includes a sheet feed motor (LF motor) 14 (FIG. 5) for driving it to move the sheet 4.

A printing sheet 4 can be fed in the direction A from the cassette or the feed port in a rear portion of the frame 2, and then turned in the direction B by the rotation of the platen roller 3. The turned sheet 4 can be discharged in the direction C from the outlet. In front of the platen roller 3, a carriage 6 can reciprocate in the directions D along the roller 3. The recording head 5 and four ink cartridges 7 are mounted on the carriage 6 removably. The head 5 includes portions each associated with one of the cartridges 7. The cartridges 7 are filled with yellow, black, cyanogen and magenta inks, respectively, and can supply the inks each to one of the head portions.

Figure 2:
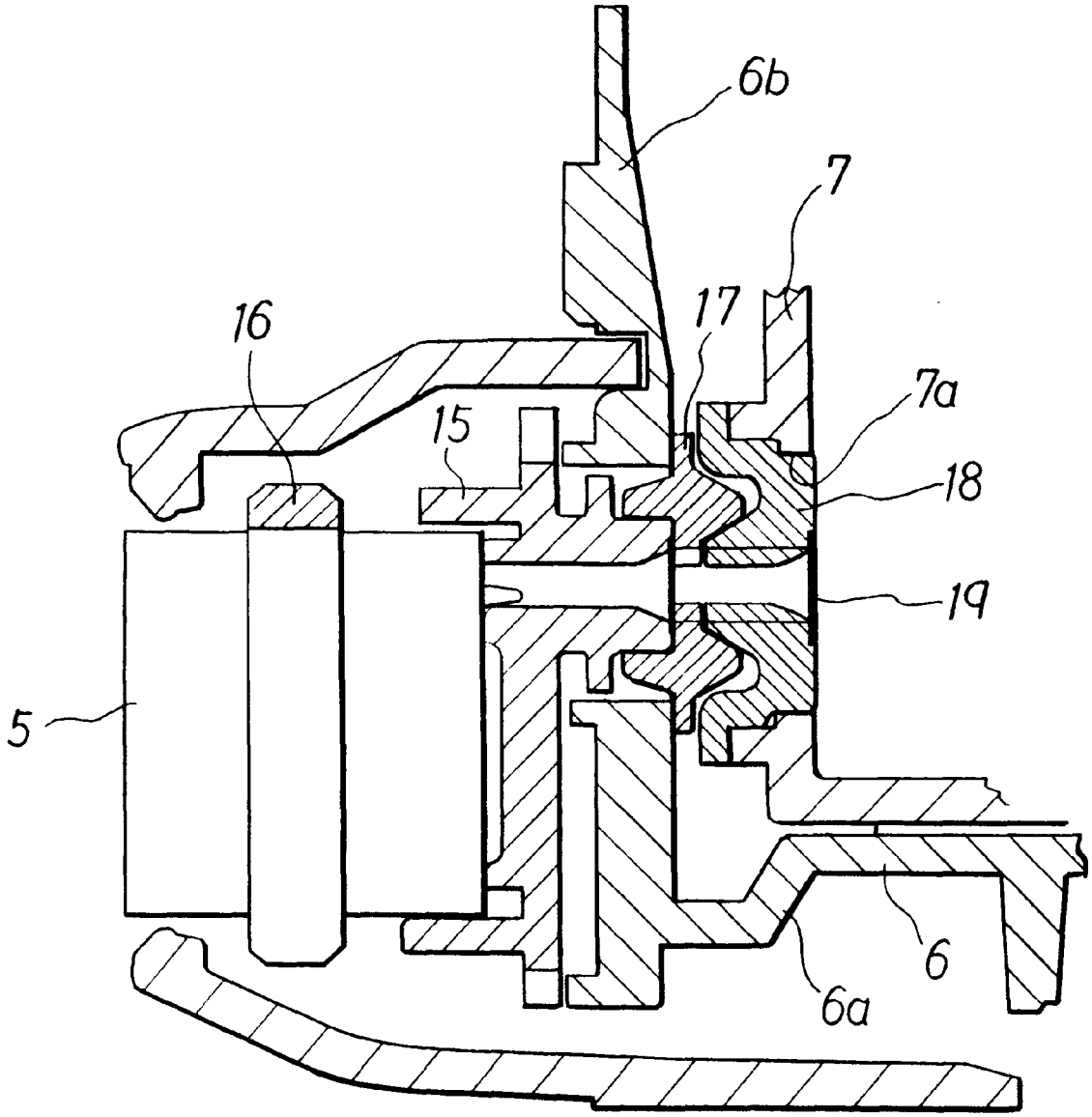
FIG. 2 is a vertical cross section of part of the printer, showing the connection between the recording head and an ink cartridge.

As shown in detail in FIG. 2, the carriage 6 includes a portion 6*a* on which the cartridges 7 can be mounted. When the cartridges 7 are mounted on the carriage portion 6*a,* they are connected through a manifold 15 to the recording head 5 supported by a head support 16. A rear end portion of the manifold 15 extends through the front wall 6*b* of the carriage portion 6*a,* and is connected through a joint 17 to the cartridges 7. The cartridges 7 each have an ink supply hole 7*a,* which is fitted with an adapter 18 for engaging with the joint 17 on its front side. The adapter 18 is fitted with a mesh filter 19 on its rear side for preventing foreign substances from moving with ink to the head 5.

A carriage shaft 8 and a guide rail 9 extend in parallel to the platen roller 3, and are fixed to the frame 2. The carriage 6 is supported slidably on the shaft 8, and includes a protrusion or portion 6*c,* which is guided or supported slidably on the rail 9. This enables the recording head 5 mounted on the carriage 6 to reciprocate along the roller 3.

Figure 5:
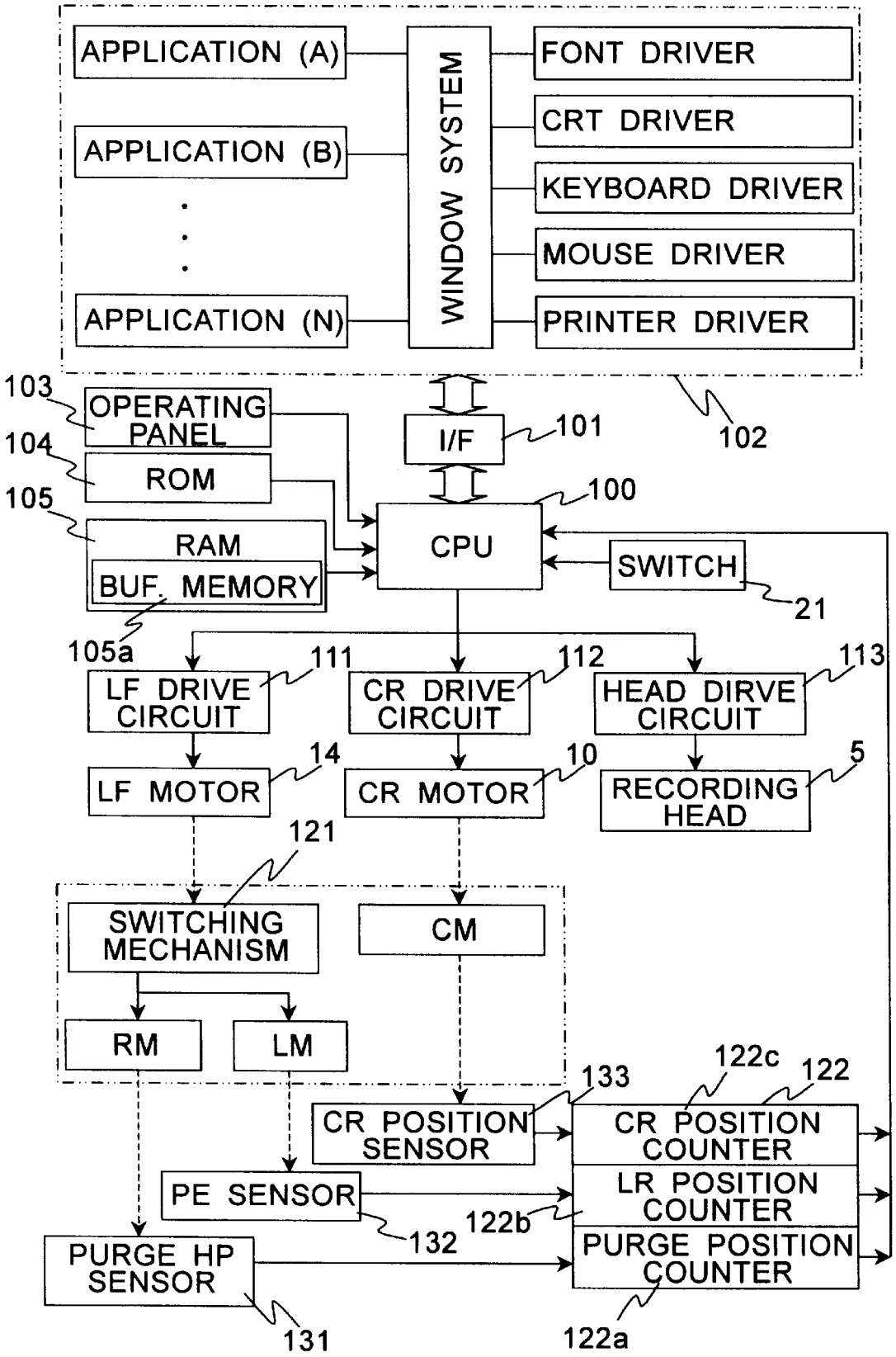
FIG. 5 is a block diagram of the controller of the printer.

A carriage drive mechanism CM includes a timing belt 11, to which the carriage 6 is fixed, and a pair of timing pulleys 12 and 13, between which the belt 11 is extended. The pulley 12 is coupled to a carriage drive motor (CR motor) 10, which may be a step motor or a DC motor. The rotation of the motor 10 drives the mechanism CM to reciprocate the carriage 6 in a recording area, where a printing sheet 4 can be printed. The recording area extends along the platen roller 3. The mechanism CM and the motor 10 constitute an apparatus for moving the carriage 6 between the recording area and a recovery area, where the recording head 5 can recover by means of a suction cap 41, a suction pump 42 and a wiper 32. The recovery area is formed on the left (right in FIG. 1) of the recording area. The carriage 6 is fitted with switches 21, one of which is shown in FIG. 5, for detecting the replacement of the cartridges 7. The switches 21 are not shown in detail in FIG. 1.

Formed on the right (left in FIG. 1) of the recording area is a flushing area, where a waste ink receiver 22 is fitted for discharging the ink in the recording head 5 in advance just before the printing operation of the head 5 to eliminate the clogging of the nozzles of the head 5 and remove the air bubbles mixing with the ink in the nozzles. While operating, an ink jet type recording head may become defective or bad in ejection of ink due to air bubbles produced in it, dried ink or other cause. In the recovery area, a purge mechanism RM is fitted for restoring the recording head 5 from defective ejection. The purge mechanism RM includes a suction apparatus 31, which includes the suction cap 41 and the pump 42. The cap 41 can move between its protruding position where it is protruded into the path of movement of the recording head 5 and its standby or waiting position where it is retracted from the path. In its protruding position, the cap 41 is in close contact with the surface of the head 5 on which nozzles are formed(the surface will be referred hereafter as "nozzle formed surface"). The pump 42 sucks ink in the head 5 through the cap 41 in close contact with the nozzle formed surface.

On the right and left (left and right in FIG. 1) of the suction apparatus 31, the wiper 32 and a capping device or apparatus 33 are fitted, respectively. The wiper 32 can move relative to the recording head 5 perpendicularly to the axis of the platen roller 3 to wipe the nozzle formed surface of the head 5. While the head 5 is not operating, the capping device 33 caps the nozzle formed surface to prevent the ink from evaporating and thereby keep the surface from drying.

The wiper 32, the suction cap 41 and the pump 42 are associated with a cam 43. The turning of the cam 43 controls the movement of the wiper 32, the movement of the suction cap 41 and the operation of the pump 42.

Figure 3:
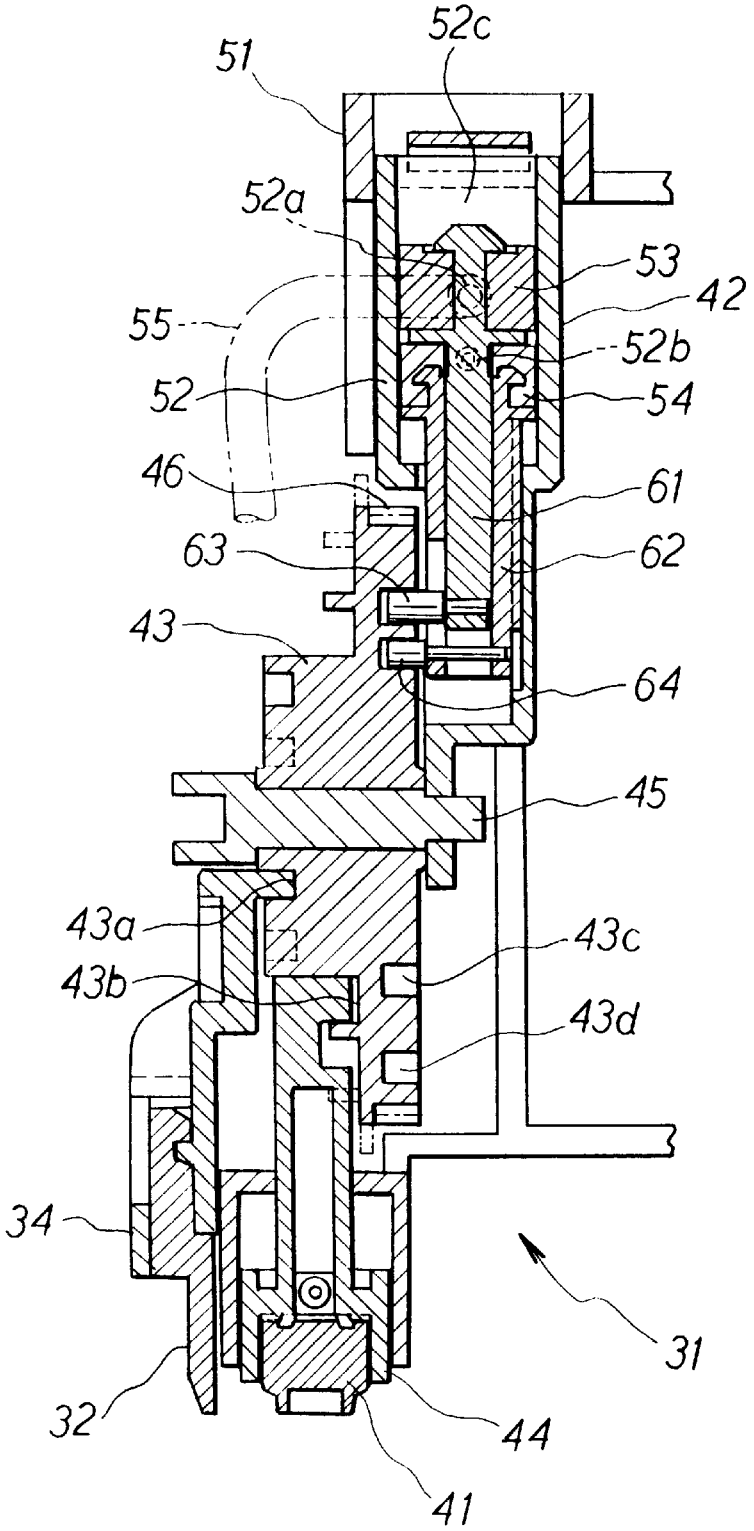
FIG. 3 is a horizontal cross section of part of the printer, showing the relationship among the wiper, the suction cap, the suction pump and the cam.
Figure 4:
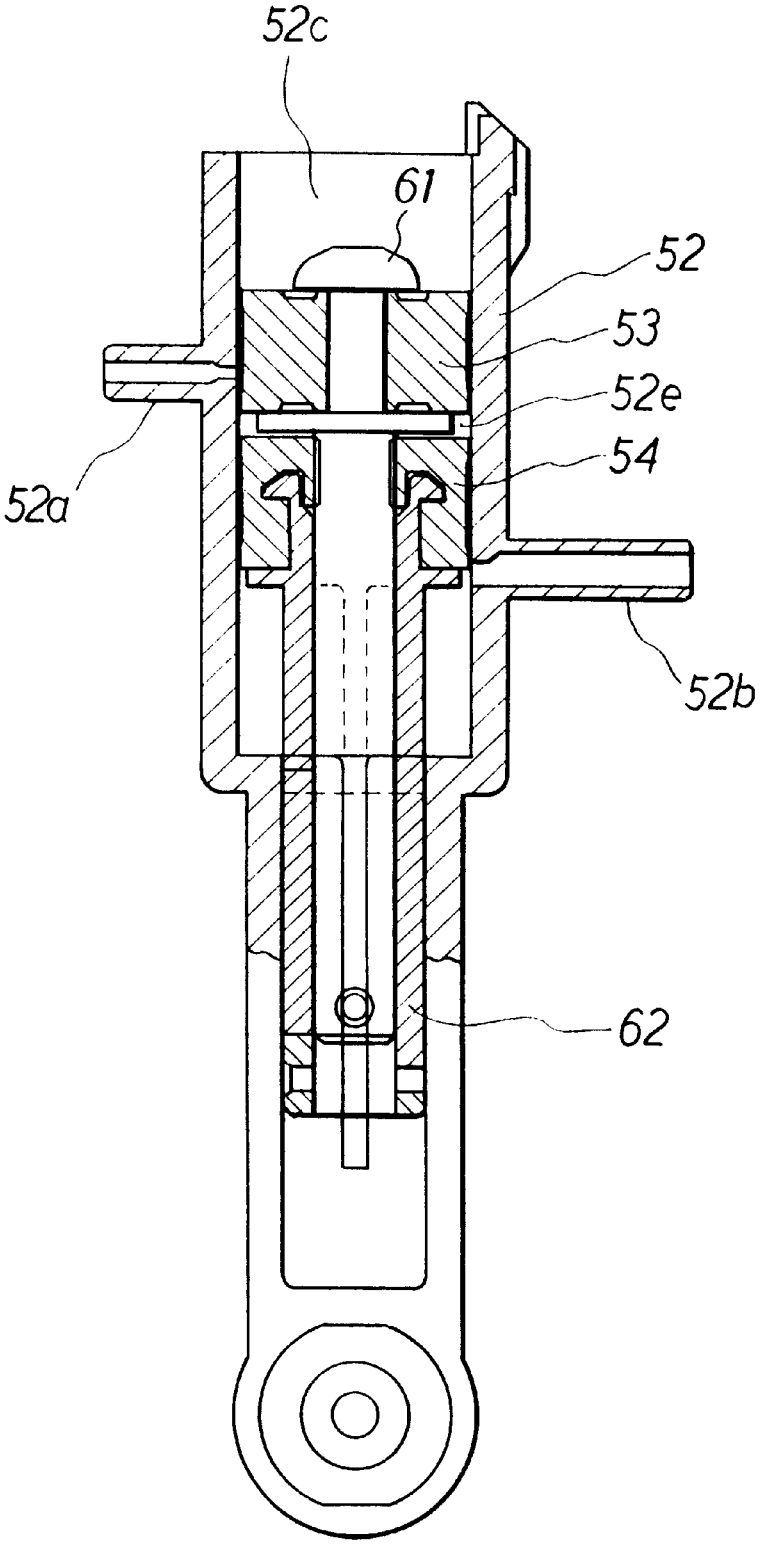
FIG. 4 is a horizontal cross section of the pump.

As shown in FIG. 3, the cam 43 includes a driven gear 46 formed integrally with it. The gear 46 can engage with and disengage from a drive gear (not shown), which can be driven by the LF motor 14 of the sheet feed mechanism LM. In this case, the motor 14 can turn the cam 43 in one direction. The cam 43 has a first cam groove 43*a* and a second cam groove 43*b* on its one side, and a third cam groove 43*c* and a fourth cam groove 43*d* on the other.

The wiper 32 is held by a holder 34 having a cam follower formed on its rear end, which is in slidable engagement with the first cam groove 43*a*. The turning of the cam 43 reciprocates the wiper 32 perpendicularly to the path of movement of the recording head 5, and between its protruding position where it is protruded into the path and its standby position where it is retracted from the path. In the protruding position, the wiper 32 can wipe the nozzle formed surface of the head 5. The suction cap 41 is held by a holder 44 having a cam follower formed on its rear end, which is in slidable engagement with the second cam groove 43*b*.

The pump 42 includes a cylindrical housing 52 mounted on and fixed to a frame member 51, which is fixed to the printer frame 2. The pump housing 52 has a suction port 52*a* and a discharge port 52*b* which are spaced axially of it. The suction port 52*a* is connected through a suction tube 55 to the suction cap 41. The discharge port 52*b* is connected to a waste ink tank 58 (FIG. 1) holding an ink absorber 57. The rear end 52*c* of the housing 52 opens to the atmosphere. A first piston 53 and a second piston 54 can independently reciprocate in the housing 52. The first piston 53 is adjacent to the open end 52*c* of the housing.

The first piston 53 and the second piston 54 are connected to the rear ends of a first drive shaft 61 and a second drive shaft 62, respectively. The first shaft 61 extends slidably through the second piston 54 and telescopically into the second shaft 62. The pistons 53 and 54 define a pump chamber between them around the first shaft 61 in the housing 52. The shafts 61 and 62 include a cam follower 63 and a cam follower 64 supported on their respective front ends. The followers 63 and 64 are in slidable engagement with the cam grooves 43*c* and 43*d,* respectively.

These cam grooves 43*c* and 43*d* are shaped for a number of sucking movements of the pistons 53 and 54. As stated later, the cam 43 can turn and pause. Various combinations of turning and pausing of the cam 43 control the suction force and time of the pump 42. The turning of the cam 43 at predetermined timing causes, in order, the suction cap 41 to cap the nozzle formed surface, the pump 42 to suck ink from the recording head 5, and the wiper 32 to wipe this part of the surface. The sucked ink is discharged through the pump 42 into the waste ink tank 58, where it is absorbed by the absorber 57.

As shown in FIG. 1, the capping apparatus 33 includes a casing 72, which supports four preservation caps 71 each for capping one of the four portions of the recording head 5. The cap casing 72 is supported slidably and pivotably on a guide rod 73, which extends in parallel to the carriage shaft 8 and is fixed to the frame 2. The casing 72 includes a protrusion 72*a* protruding forward to engage with the carriage 6. The casing 72 is urged or biased to the left in FIG. 1 by a spring (not shown) and clockwise in FIG. 1 by another spring (not shown). When the carriage 6 moves from the recording area to the recovery area, it engages with the casing protrusion 72*a* and moves with the casing 72. Consequently, the preservation caps 71 follow the carriage 6 to the right in FIG. 1. When the casing 72 slides in this direction, an inclined cam (not shown) causes it to pivot around the guide rod 73 counterclockwise in FIG. 1. As a result, the caps 71 contact with and cap the nozzle formed surface of the recording head 5. When the carriage 6 moves back toward the recording area, the caps 71 move toward this area and, at the same time, leave the head 5 clockwise in FIG. 1. When the carriage 6 leaves the recovery area, the printer 1 returns to its initial condition.

U.S. Pat. No. 5,639,220 discloses an ink jet printer including a purge mechanism, a capping apparatus and a wiper, all as stated above, and is incorporated herein by reference.

With reference to FIG. 5, the controller of the printer 1 includes a CPU 100, which is a known processing unit. The CPU 100 is connected through an interface 101 to a host computer 102, which may be a personal computer. The CPU 100 can receive printing commands from the computer 102, and carry out various types of printing in accordance with the commands.

Typical operating systems of a personal computer include a window system. The host computer 102 operates with a window system, on which various applications (A, B, . . . N) run. Incorporated in the system are a font driver, CRT driver, a keyboard driver, a mouse driver, a printer driver, etc. When the printer 1 prints a sheet of paper while some of the applications are running, the printer driver outputs data related to an image suitable for the printing function of the printer. The CPU 100 is connected to an operating panel 103, a ROM 104 and a RAM 105. The panel 103 is used to set and display sheet size and other parameters. The ROM 104 is used to store programs for controlling the printer 1. The RAM 105 is used to temporarily store the printing data transferred from the host computer 102 and numeric values for controlling the printer 1. The RAM 105 has a backup memory 105*a*.

The CPU 100 controls the driving of the LF motor 14, the CR motor 10 and the recording head 5 through an LF drive circuit 111, a CR drive circuit 112 and a head drive circuit 113, respectively. The CPU 100 receives signals from the switches 21, which are fitted on the carriage 6, for detecting the replacement of the cartridges 7.

A switching or change-over mechanism 121 includes the drive gear (not shown) which can mesh with the driven gear 46 of the cam 43. The LF motor 14 can drive one of the purge mechanism RM and the sheet feed mechanism LM selectively through the switching mechanism 121. The CPU 100 can control the operation of the pump 42 to make a purge.

Figure 8A:
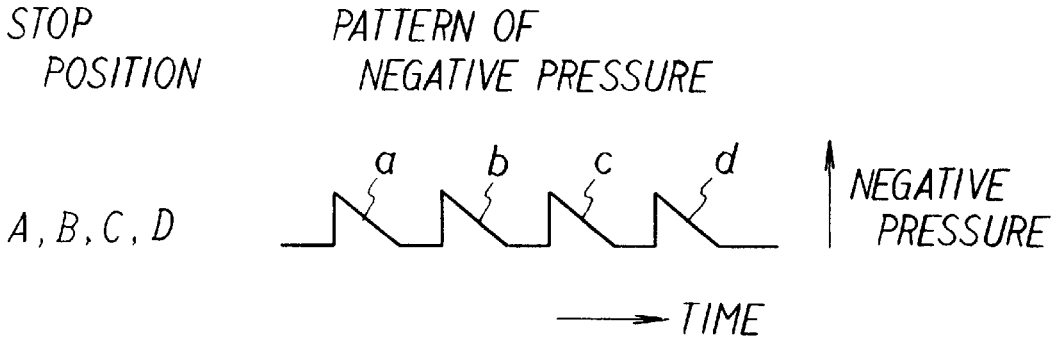
FIGS. 8A–8D are charts of the changes in the negative pressure for suction developed by the suction apparatus in accordance with the first embodiment.

As shown in FIG. 8A, the pump 42 can perform a series of actions or performances including a plurality of suction actions. By controlling the pump 42 through the cam 43, the CPU 100 can selectively combine some or all of the suction actions to change the number of suction actions and the suction force of the pump 42. For example, the replacement of each cartridge 7 involves suction actions which are small in suction force and each short in suction time to suck ink without the ink bubbling. The periodic maintenance of the recording head 6 involves a suction action which is relatively great in suction force and relatively long in suction time to maintain a good ejection condition. The recovery of the head 5 from defective ejection involves a suction action which is great in suction force and long in suction time.

In accordance with a second embodiment of the invention, the control of the CPU 100 can drive the pump pistons 53 and 54 selectively at different speeds in a suction action for sucking ink from the recording head 5 by means of the suction apparatus 31 with the suction cap 41 in close or tight contact with the nozzle formed surface of the head 5. Specifically, the pistons 53 and 54 can be driven selectively at different speeds by combinations of continuous driving and intermittent driving of the pistons, combinations of intermittent driving of one of the pistons at a cycle period (frequency) and intermittent driving of the other piston at another cycle period, or combinations of all of them.

Figure 14A:
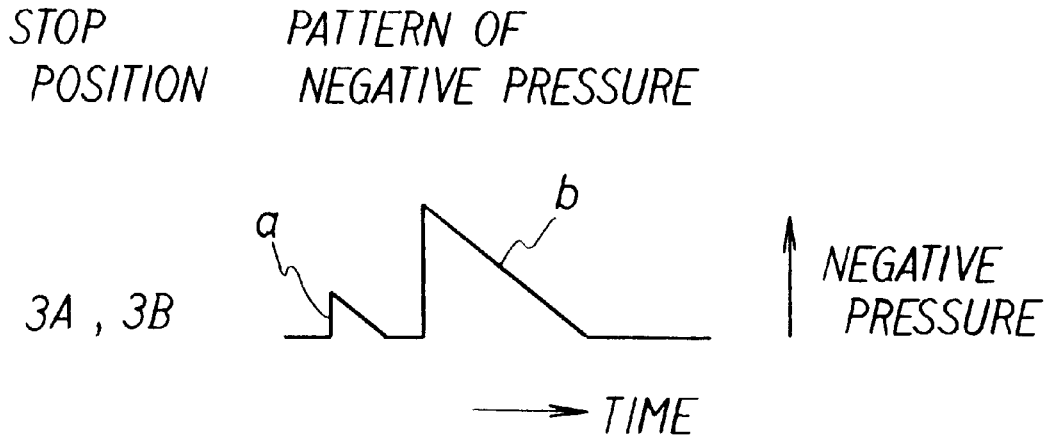
FIGS. 14A and 14B are charts of the changes in the negative pressure for suction developed by the suction apparatus in accordance with the third embodiment.
Figure 14B:
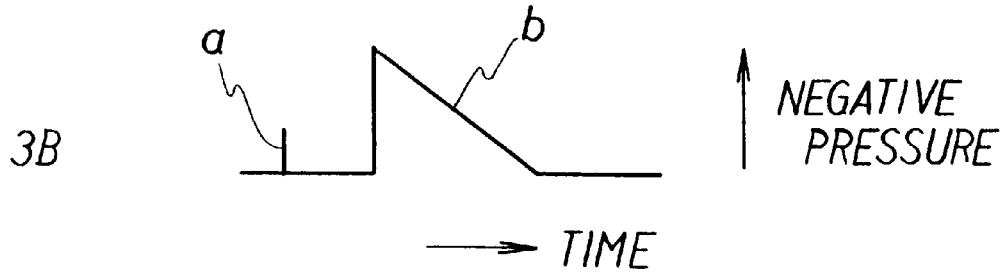

In accordance with a third embodiment of the invention, the pump 42 can perform a series of actions including a plurality of suction actions. The CPU 100 can control the pump 42 in such a manner that one or more of the suction actions vanish selectively. Specifically, as shown in FIG. 14A, the pump 42 can perform a first suction action A and a second suction action "b". The action "a" is small in suction force and short in suction time (a small wave of negative pressure). The second action "b" is great in suction force and long in suction time (a large wave of negative pressure). When each cartridge 7 is replaced and the CPU 100 receives a signal from the associated detection switch 21, the CPU selects both of the first and second suction actions, and makes neither of them vanish (FIG. 14A). For a normal purge without replacing the cartridges 7, the CPU 100 controls the rotation of the LF motor 14, which drives the cam 43, in such a manner that the first action "a" vanishes and only the second action "b" is performed (FIG. 14B).

The CR motor 10 can, as stated above, drive the carriage drive mechanism CM. The movement of the carriage 6 causes the switching mechanism 121 (FIG. 5) to change over.

The purge mechanism RM has a purge HP sensor 131. The sheet feed mechanism LM has a PE sensor 132. The carriage drive mechanism CM has a CR position sensor 133. The sensors 131, 132 and 133 can supply the CPU 100 with detection signals through a counter group 122, which consists of a purge position counter 122*a*, an LF position counter 122*b* and a CR position counter 122*c*.

When the pump 42 is at its home position (0 degree in FIG. 7), the purge HP sensor 131 signals or informs the purge position counter 122*a* that the pump is at this position. This signal is the reference for the purging operation of the purge mechanism RM.

When the PE sensor 132 detects the front end of a newly fed recording sheet 4, it signals the LF position counter 122*b*. This signal is the reference for controlling the recording position in the direction of sheet movement.

The CR position sensor 133 counts the drive pulses of the CR motor 10 to detect the position of the carriage 6, and informs the CR position counter 122*c* of this position. This positional information is the reference for controlling the holding position in the directions of carriage movement. This information is also the reference with (by) which it is decided whether a new recording sheet can be fed and whether a printed sheet can be discharged.

The operation of the printer 1 will be explained below. Normally, the recording head 5 is in its standby position, where it is capped with the preservation caps 71. Then, if recording data are input into the CPU 100, the printer 1 starts recording. A recording sheet 4 is fed to the space between the platen roller 3 and the recording head 5. In the meantime, the CR motor 10 operates to move the head 5 from the standby position to the recording start position. The head 5 prints the sheet 4 by ejecting ink in accordance with the recording data while reciprocated in the recording area. When the printing ends, the head 5 is returned to the standby position, where it is capped with the preservation caps 71 in order for its nozzle formed surface to be kept from drying while it is not used.

For example, if defective ejection of ink occurs, the printer user may decide to turn on the purge switch on the operating panel 103. If the purge command is input into the CPU 100, the printer 1 is put in the purge mode, in which the purge mechanism RM operates and, as stated later, a suction program runs.

If defective ejection of ink occurs, the purge switch may be turned on to cause the pump 42 to suck ink as stated above. The pump 42 sucks ink also when each cartridge 7 is replaced with a new one and it is therefore necessary to suck ink from the new cartridge into the recording head 5. If each cartridge 7 is replaced, the associated detection switch 21 on the carriage 6 detects the replacement. Then, the control of the CPU 100 causes the pump 42 to suck ink. If the head 5 is not used for recording for a long time, its nozzles start to dry even though its nozzle formed surface is capped with the preservation caps 71. In this case, the pump 42 sucks ink for automatic maintenance depending on the length of the nonuse period, to maintain a good ejection condition. When printing starts or at another time, the pump 42 sucks ink automatically in accordance with the length of the nonuse period just before then by means of a timer, which is formed by the CPU 100, the ROM 104 and the RAM 105.

During automatic maintenance, the pump 42 is controlled in such a manner that the pistons 53 and 54 are driven at lower speeds than during a purge for recovery from defective ejection of ink to lower the maximum negative pressure for suction. After cartridge replacement, the pump 42 is controlled in such a manner that the pistons 53 and 54 are driven at even lower speeds than during automatic maintenance to further lower the maximum negative pressure for suction. Thus, depending on the conditions of the nozzles in the recording head 5 and the ink passages, the form of suction is varied as stated later.

In the third embodiment described later, the introduction of ink after cartridge replacement involves the first suction action "a", which is small in suction force and short in suction time, and the second suction action "b", which is great in suction force and long in suction time (FIG. 14A). On the other hand, for ink suction not after cartridge replacement, the CPU 100 makes the first action vanish (FIG. 14B) to vary the form of ink introduction.

In the purge mode, on the basis of the suction program, the CPU 100 first makes the CR drive circuit 112 actuate the CR motor 10 to drive the carriage drive mechanism CM in such a manner that the recording head 5 moves from the position where it faces the preservation caps 71 to the position where it faces the suction cap 41. When the head 5 is positioned in the recovery area, the LF motor 14 is already switched by the switching mechanism 121 to its condition in which it can transmit driving force to the purge mechanism RM. The driving force from the LF motor 14 turns the cam 43. For a good ejection condition, the wiper 32, the suction cap 14 and the pump 42 are controlled to perform a series of recovery actions for the head 5. The recovery actions include bringing the cap 41 and the wiper 32 into and out of contact with the head 5, sucking ink from the head 5 by means of the pump 42, and discharging the sucked ink by means of the pump. The suction actions of the pump 42 include sucking ink from the head 5 with the cap 41 in close contact with the nozzle formed surface, and sucking ink from the inside of the cap 41 together with air with at least part of the cap out of contact with the nozzle formed surface.

With reference to FIGS. 6A–6L, 7 and 8A–8D, the contact or engagement of the suction cap 41 and the wiper 32 with the recording head 5, the disengagement of them from it, and the suction and the discharge by means of the pump 42 in accordance with the first embodiment will be described below along the change in the turning angle of the cam 43. In this embodiment, the turning speed of the cam 43 is constant.

Figure 6A:
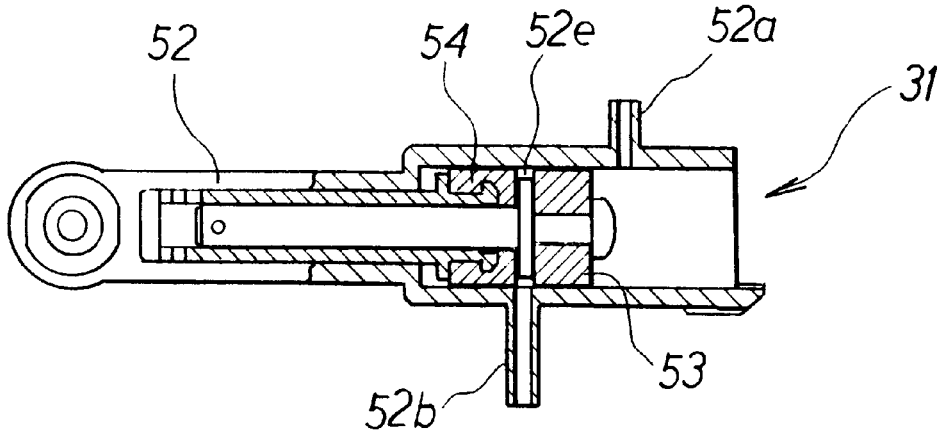
FIGS. 6A–6L are horizontal cross sections of the pump, showing the pump operation according to a first embodiment.
Figure 7:
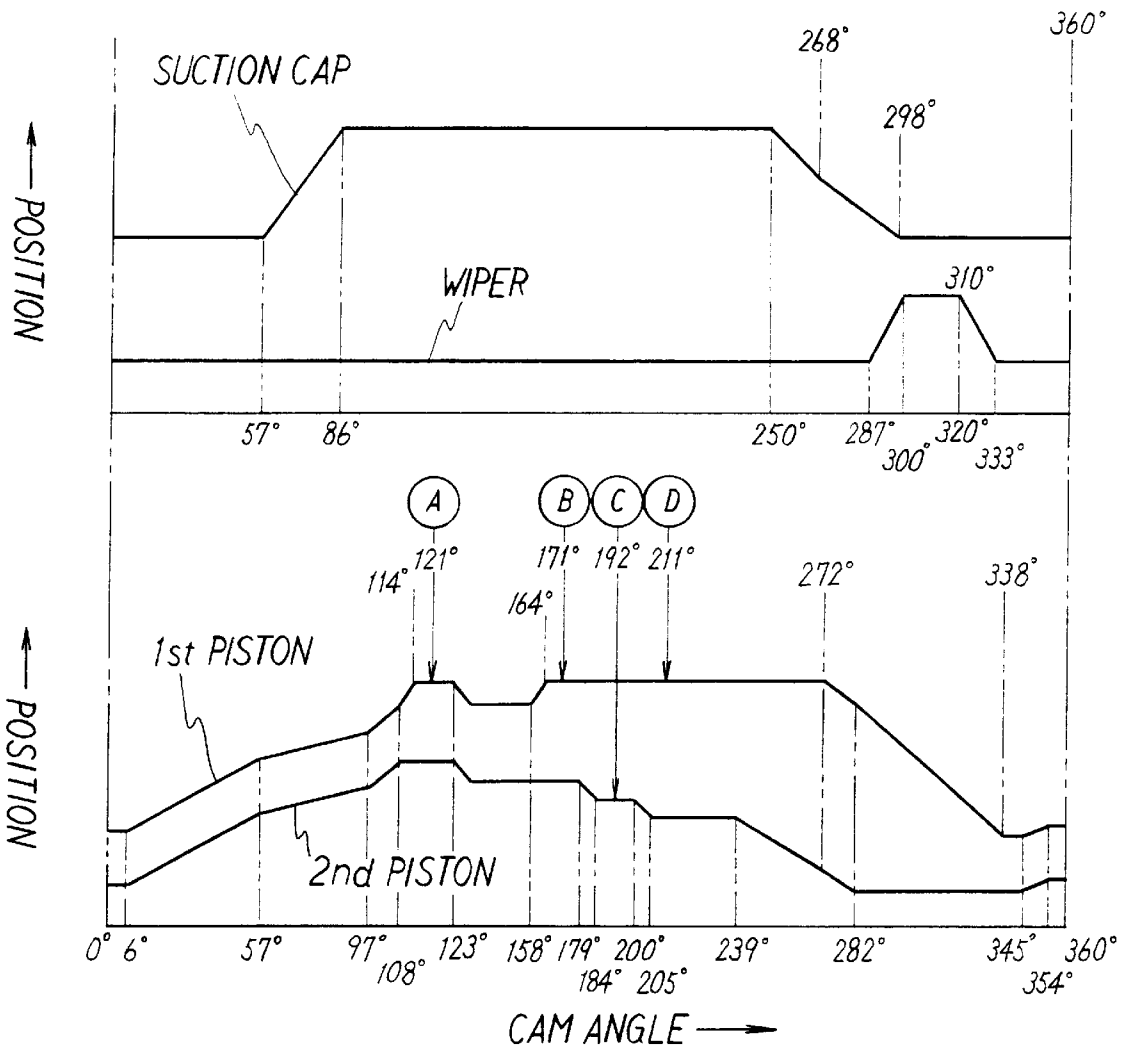
FIG. 7 is a chart of the relationship among the turning angle of the cam and the movements or actions of the suction cap, the wiper and the pump in accordance with the first embodiment.

With reference first to FIG. 6A, when the turning angle of the cam 43 is around 0 degree, the pump chamber 52*e* between the pistons 53 and 54 is smallest in volume, and positioned near the discharge port 52*b*. In the meantime, the suction cap 41 is in its initial condition, in which it is at its standby position away from the recording head 5 (FIG. 7).

Figure 6B:
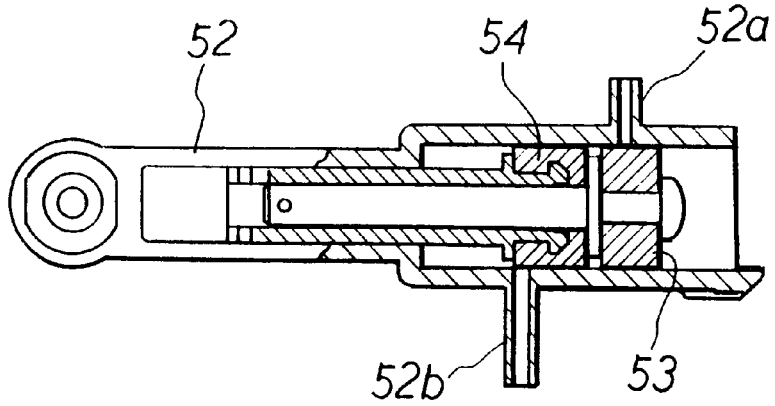
Figure 6C:
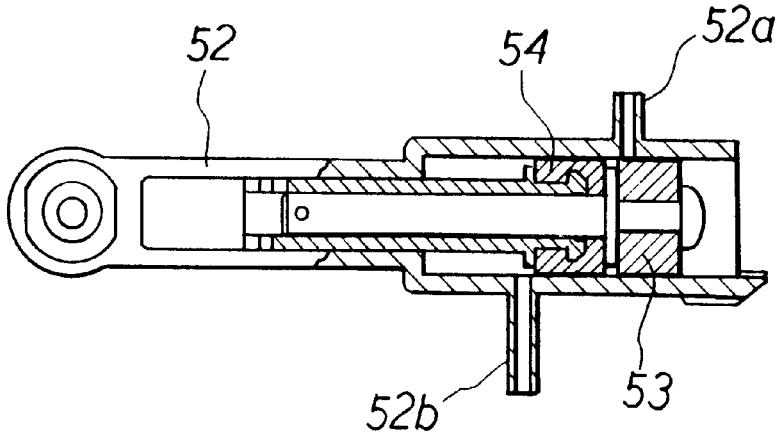

While the cam 43 is turning from its turning angle of about 6 degrees, the pistons 53 and 54 move backward together gradually at the same speed (FIG. 6B). At about 57 degrees, the pistons 53 and 54 decelerate a little. At about 97 degrees, the pistons 53 and 54 are accelerated by the forms of the cam grooves 43*c* and 43*d*. When the cam 43 reaches its turning angle of about 57 degrees, as shown in FIG. 7, while the pistons 53 and 54 are moving, the suction cap 41 starts to move gradually from its standby position to the path of movement of the recording head 5. At about 86 degrees, the cap 41 starts to cap the nozzle formed surface of the head 5.

Figure 6D:
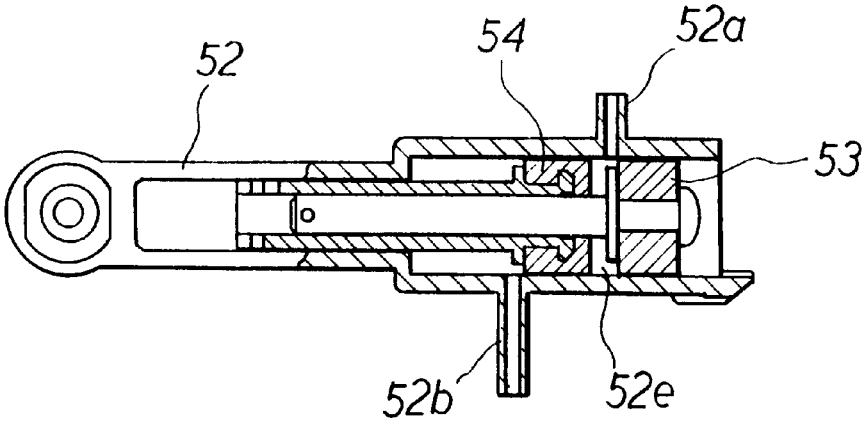

When the turning angle of the cam 43 reaches about 108 degrees (FIG. 6C), the second piston 54 stops while only the first piston 53 is moving so that the pump chamber 52*e* enlarges and communicates with the suction port 52*a* (FIG. 6D). At about 114 degrees, the first piston 53 stops. From about 114 through 129 degrees, both pistons 53 and 54 keep stopping. At about 121 degrees (position A), the cam 43 stops for three seconds so that a first suction action which is small in suction force and short in suction time is performed ("a" in FIGS. 8A–8D).

Figure 6E:
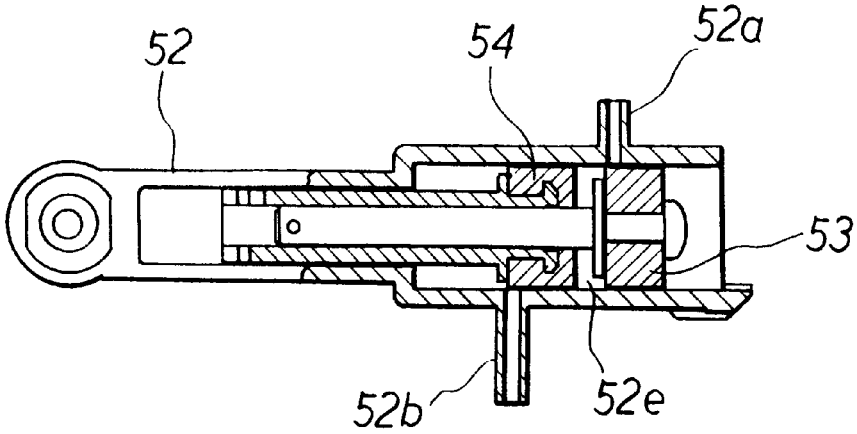
Figure 6F:
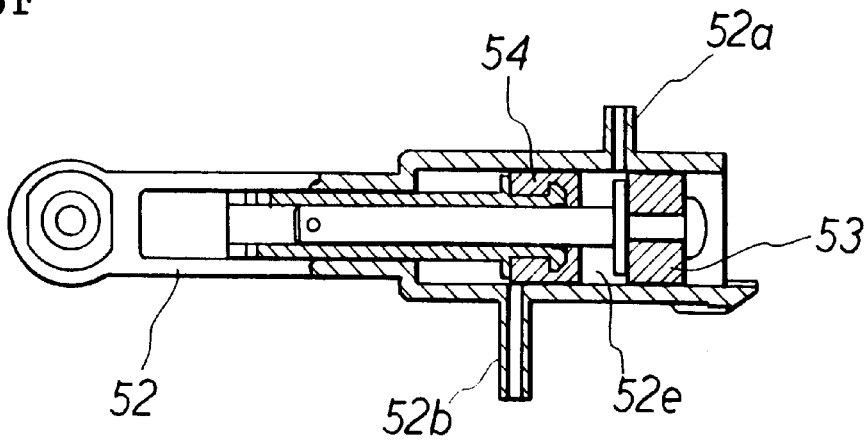
Figure 6G:
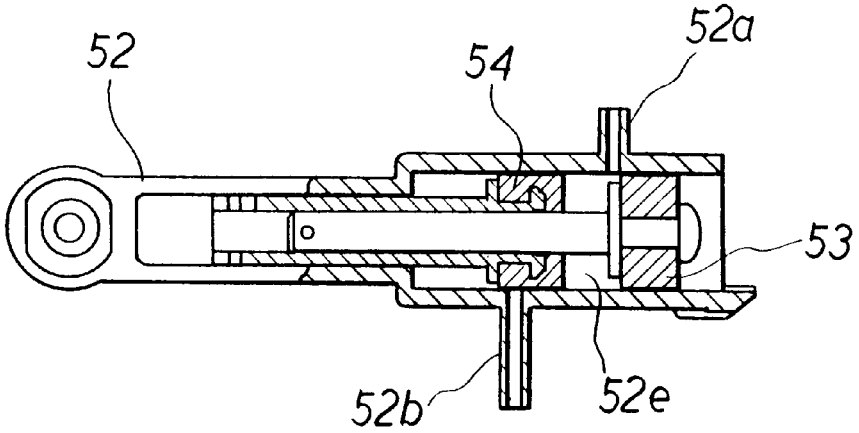
Figure 6H:
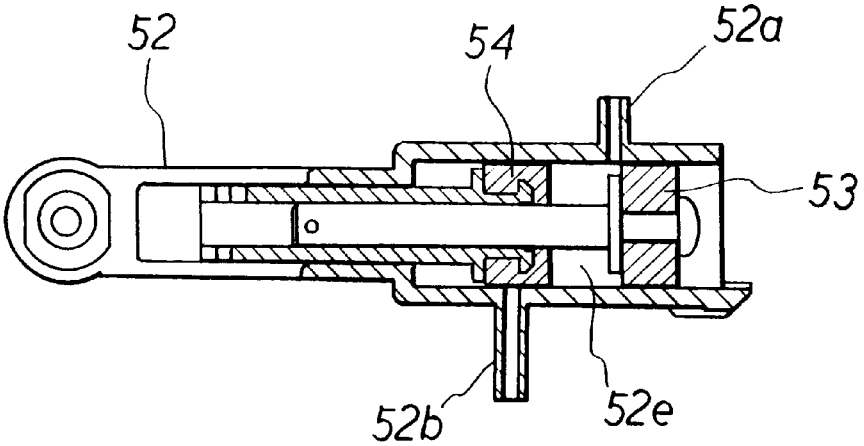
Figure 6I:
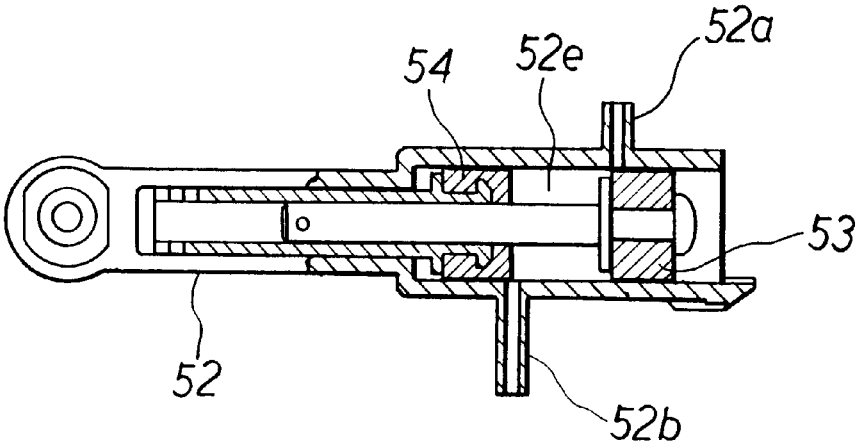
Figure 6J:
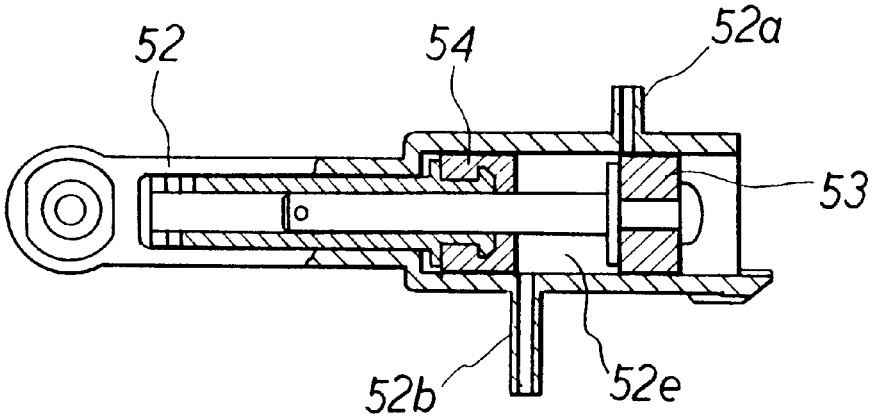

Then, the pistons 53 and 54 move toward the discharge port 52*b* until the first piston 53 closes the suction port 52*a* (FIG. 6E). After this port 52*a* is closed and until the cam 43 turns to 158 degrees, the pistons 53 and 54 stop. From 158 through 164 degrees, while the second piston 54 is stopping, the first piston 53 moves away from the second piston so that the piston chamber 52*e* enlarges and communicates with the suction port 52*a* again (FIG. 6F). From 164 through 179 degrees, both pistons 53 and 54 stop. At about 171 degrees (position B), the cam 43 stops for three seconds so that a second suction action which is small in suction force and short in suction time is performed ("b" in FIGS. 8A and 8C).

The pistons 53 and 54 are moved differently by the different profiles of the cam grooves 43*d* and 43*c* engaging with the drive shafts 61 and 62, respectively, connected to the pistons 53 and 54, respectively.

While the cam 43 is turning from 179 through 184 degrees and the first piston 53 is stopping, the second piston 54 moves away from the first piston (FIG. 6G) to enlarge the pump chamber 52*e*. From 184 through 200 degrees, both pistons 53 and 54 stop. At about 192 degrees (position C), the cam 43 stops for three seconds so that a third suction action which is small in suction force and short in suction time is performed ("c" in FIG. 8A).

Normally, the cam 43 turns at a speed of 120 degrees per second (360 degrees in 3 seconds). Without halting or temporarily stopping at the position B, the cam 43 may stop at the position C for five seconds. This is equivalent to the enlargement of the pump chamber 52*e* from 164 through 184 degrees nearly at a time, although negative pressure develops momentarily at 164 degrees. This enlargement of the chamber 52*e* makes the negative pressure for suction higher than if the cam 43 stops at the position B. As a result, a suction action is performed with great suction force for a relatively long time ("e" in FIG. 8B).

While the cam 43 is turning from 200 through 205 degrees and the first piston 53 is stopping, the second piston 54 moves away from the first piston (FIG. 6H) to make the pump chamber 52*e* larger. From 205 through 239 degrees, both pistons 53 and 54 stop to keep the chamber 52*e* constant in volume. At about 211 degrees (position D), the cam 43 stops for three seconds so that a fourth suction action which is small in suction force and short in suction time is performed ("d" in FIG. 8A).

Without halting at the position C, the cam 43 may stop at the position D for three seconds. This is equivalent to the enlargement of the pump chamber 52*e* from 184 through 205 degrees nearly at a time, although negative pressure develops momentarily at 184 degrees. This enlargement makes the negative pressure for suction higher than if the cam 43 stops at the position C. As a result, a suction action is performed with great suction force for a relatively long time ("f" in FIG. 8C).

Otherwise, without halting at the positions B and C, the cam 43 may stop at the position D for five seconds. In this case, the enlargement of the pump chamber 52*e* from 164 through 205 degrees occurs nearly at a time, making the negative pressure for suction very high. As a result, a suction action is performed with great suction force for a long time ("g" in FIG. 8D).

While the cam 43 is turning from 239 through 272 degrees and the first piston 53 is stopping, the second piston 54 moves farther from the first piston (FIG. 6I) to suck ink. From about 272 degrees, the first piston 53 follows the second piston 54, and closes the suction port 52*a*.

Figure 6K:
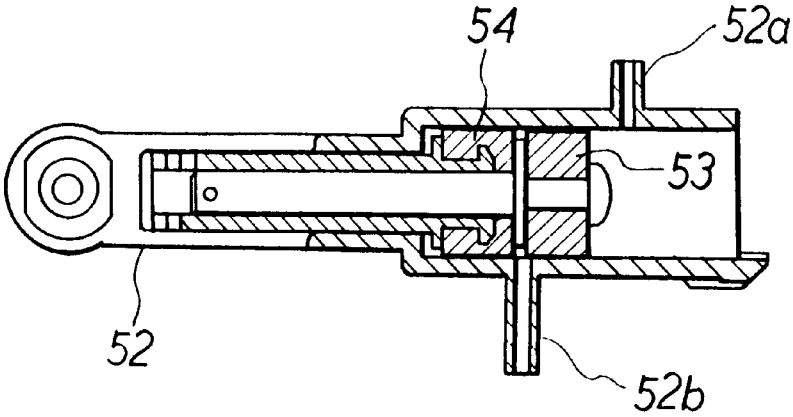
Figure 6L:
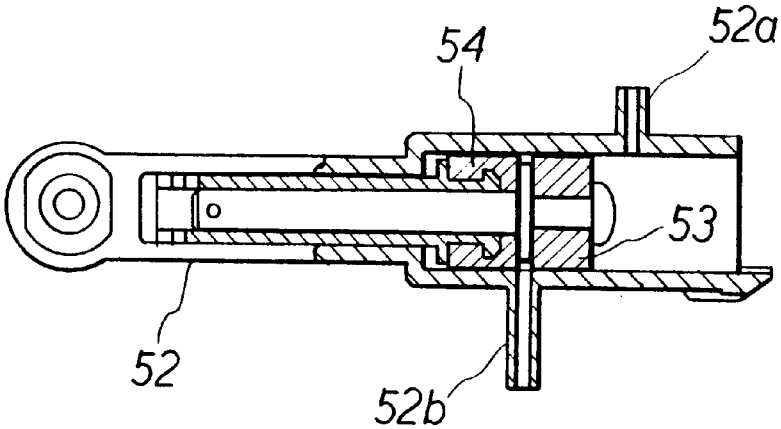

When the cam 43 reaches about 282 degrees, the second piston 54 makes the pump chamber 52*e* communicate with the suction port 52*b* (FIG. 6J), and stops. In the meantime, until about 338 degrees, the first piston 53 keeps moving, contracting the chamber 52*e* to perform a discharge action (FIG. 6K). While the cam 43 is turning from about 86 through about 250 degrees, the suction cap 41 is kept in close contact with the nozzle formed surface of the recording head 5.

From 250 through 268 degrees, the cap 41 retracts gradually from the head 5. From 268 through 298 degrees, the cap 41 retracts further at a slightly lower speed. When the cam 43 turns to 298 degrees, the cap 41 returns to its initial position. Therefore, from about 250 degrees, the movements of the pistons 53 and 54 do not suck ink from the head 5, but discharges ink remaining in the cap 41 and the tube 55.

After the ink is discharged, both pistons 53 and 54 stop while the cam 43 is turning from 338 through 345 degrees. From 345 through 354 degrees, the pistons 53 and 54 move a little back to the position shown in FIG. 6L. This returns the pump 42 to its substantially initial condition. This condition is maintained from 354 through 360 (0) degrees, and then the pump 42 returns to its initial condition.

The wiper 32 is kept in its standby condition while the cam 43 is turning from 0 through 287 degrees. The wiper 32 moves forward gradually from 287 through 300 degrees, reaches its protruding position at 300 degrees, and keeps this position from 300 through 320 degrees. In the protruding position, the wiper 32 wipes the nozzle formed surface of the recording head 5 moving toward the recording area (FIG. 7). The wiper 32 retracts gradually from 320 through 333 degrees, reaches its standby position at 333 degrees, and keeps standing by until the cam 43 reaches 360 degrees.

After the wiper 32 wipes the nozzle formed surface of the recording head 5, the head first moves to the flushing area, where ink is ejected preliminarily from all the nozzles of the head 5 into the waste ink receiver 22. Then, the head 5 moves to its recording start position.

Figure 8B:
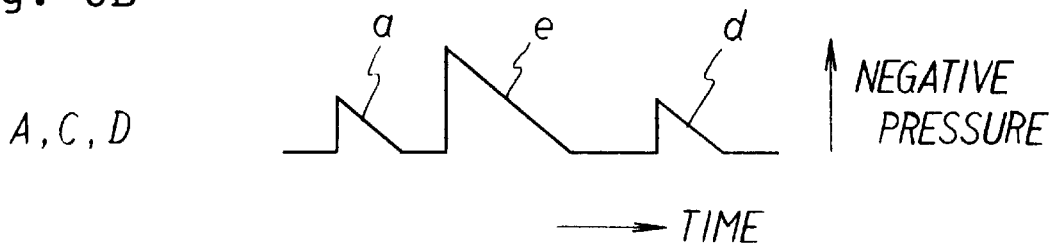
Figure 8C:
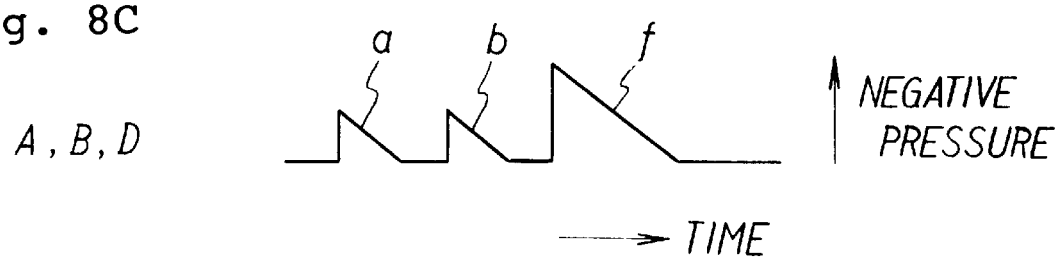
Figure 8D:
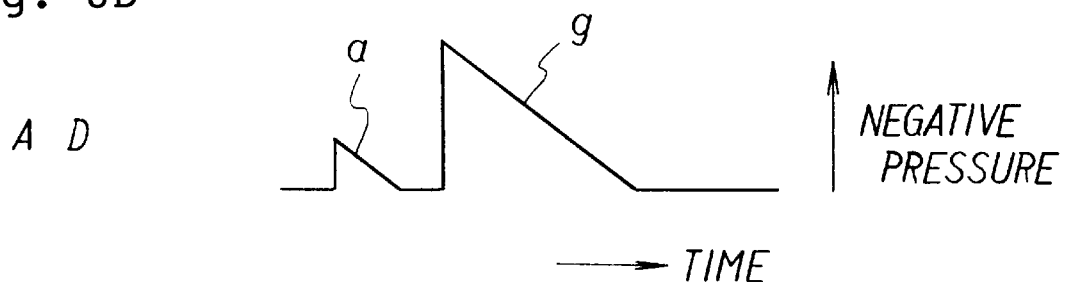

Thus, as shown in FIG. 8A, the pump 42 can basically perform the four suction actions. As shown in FIGS. 8B–8D, the CPU 100 can change the number of suction actions and the suction force, with the four actions selectively combined, by skipping or omitting the halt or halts of the cam 43 at any of the positions B, C and D.

After each cartridge 7 is replaced with a new one, the ink passage between the recording head 5 and the new cartridge is filled with air. If the pump 42 applied high negative pressure through the suction cap 41 to suck ink at a dash or whack from the head 5 connected to the new cartridge 7, a mixture of ink and air would flow rapidly from the cartridge 7 toward and into the head. The rapidly flowing ink would bubble, and consequently the ink in the head 5 would contain air bubbles. As shown in FIG. 8A, however, by performing the four suction actions which are small in suction force and each short in suction time, it is possible to suck ink gradually from the new cartridge 7 while expelling the air in the associated ink passage. Therefore, when ink is sucked from the new cartridge 7, the ink is prevented from bubbling, and consequently the ink in the head 5 is prevented from containing air.

For example, the first suction action "a" indicated in FIG. 8A may cause ink to flow gradually through the cartridge filter 19. The second action "b" may fill the manifold 15 gradually with ink. The third action "c" may introduce ink into the associated channels in the recording head 5. The fourth action "d" may suck a predetermined amount of ink from the head 5 into the suction cap 41.

Before printing starts, automatic maintenance is performed depending on the length of the nonuse period. In this case, because the ink passage between each cartridge 7 and the recording head 5 is filled with ink, even great suction force causes no ink to bubble. In this case, it is only necessary to remove drying ink. As shown in FIGS. 8B and 8C, the removal of drying ink involves the suction action "e" or "f" which is relatively great in suction force and relatively long in suction time to maintain a good ejection condition. Either of FIGS. 8B and 8C may be selected properly depending on the length of the nonuse period.

As shown in FIG. 8D, a purge for recovery from defective ejection involves the suction action "g" which is greater in suction force and longer in suction time. This action sucks ink at a dash through the suction cap 41 to recover a good ejection condition.

Thus, after cartridge replacement, during periodic maintenance, and during a purge for recovery from defective ejection, it is possible to perform the optimum suction actions depending on the conditions of the nozzles in the recording head 5 and the ink passages by varying the form of ink suction. Each of the suction forms shown in FIGS. 8A–8D begins with the first suction action "a", which is small in suction force and short in suction time. The first action "a" may, however, be omitted as the occasion demands.

Depending on purposes, two or more series of actions including the suction actions may be performed. For example, after each cartridge 7 is replaced, the first through fourth suction actions are performed in order as the first series of actions to introduce ink into the recording head 5 without the ink bubbling as stated above. As each of the second and subsequent series, any of the suction forms shown in FIGS. 8B–8D is performed because no ink bubbles. This makes it possible to fill the head 5 securely with new ink so that the head can eject ink. A combination of the forms shown in FIGS. 8B–8D can be repeated also during a purge performed suitably by the user's keying, and during maintenance performed automatically by the printer.

In particular, for automatic maintenance, the number of repetitions may be set depending on the length of the nonuse period.

In accordance with this embodiment, it is decided when each cartridge 7 should be replaced by whether there is a signal from the associated detection switch 21 or not. Otherwise, this might be decided by the user's keying. The pump 42 might include a single piston, in place of the pistons 53 and 54. It might be possible to change the speeds of the pistons 53 and 54 by varying the rotational speed of the motor 14, instead of driving and halting the pistons. The piston pump 42 might be replaced by another type of pump.

Second Embodiment

An ink jet printer according to the second embodiment is substantially identical with the printer 1 of the first embodiment, and equivalent parts are assigned the same reference numerals. The cam grooves 43*c* and 43*d* (FIG. 3) of this embodiment are formed differently from the counterparts of that embodiment.

With reference to FIGS. 9A–9H, 10 and 11A–11E, the contact of the suction cap 41 and the wiper 32 with the recording head 5, the disengagement of them from it, and the suction and the discharge by means of the suction pump 42 in accordance with the second embodiment will be described below along the change in the turning angle of the cam 43.

Figure 9A:
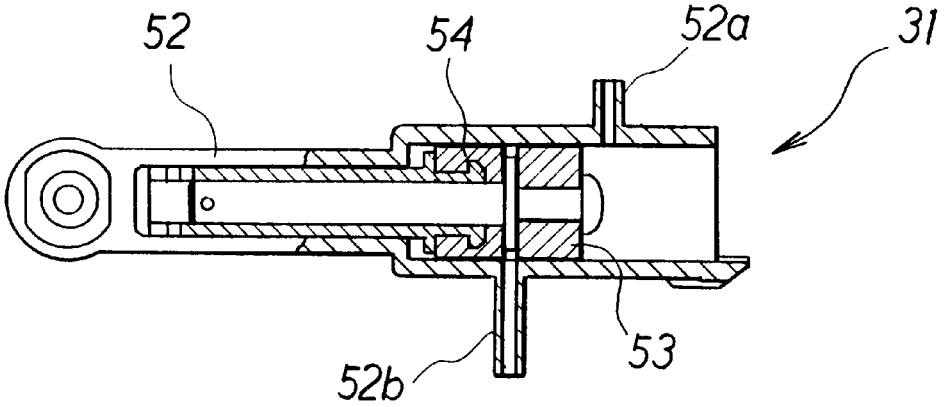
FIGS. 9A–9H are horizontal cross sections of the pump, showing the pump operation according to a second embodiment.

With reference first to FIG. 9A, when the turning angle of the cam 43 is around 0 degree, the pump chamber 52*e* between the pistons 53 and 54 is smallest in volume, and positioned near the discharge port 52*b*. In the meantime, the suction cap 41 is in its initial condition, in which it is at its standby position away from the recording head 5.

Figure 9B:
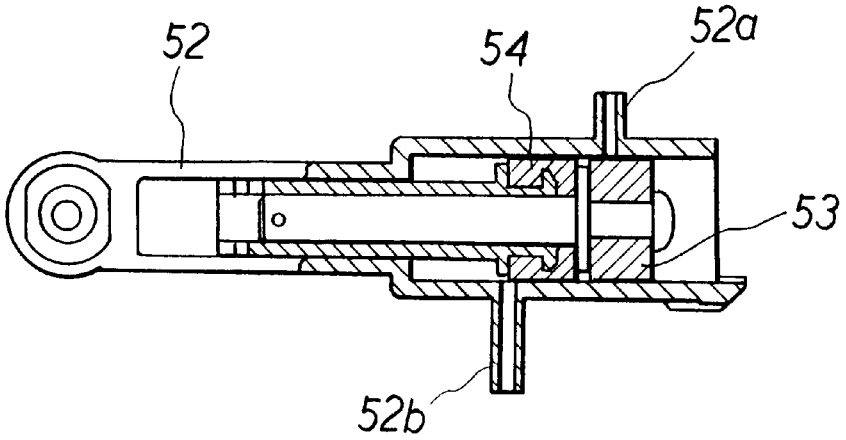

While the cam 43 is turning from about 6 degrees, the pistons 53 and 54 move together gradually backward. At about 97 degrees, the pistons 53 and 54 accelerate a little (FIG. 9B). When the cam 43 reaches about 114 degrees, the forms of the cam grooves 43*c* and 43*d* stop the pistons 53 and 54, and position the pump chamber 52*e* near the suction port 52*a* (FIG. 9C).

Figure 10:
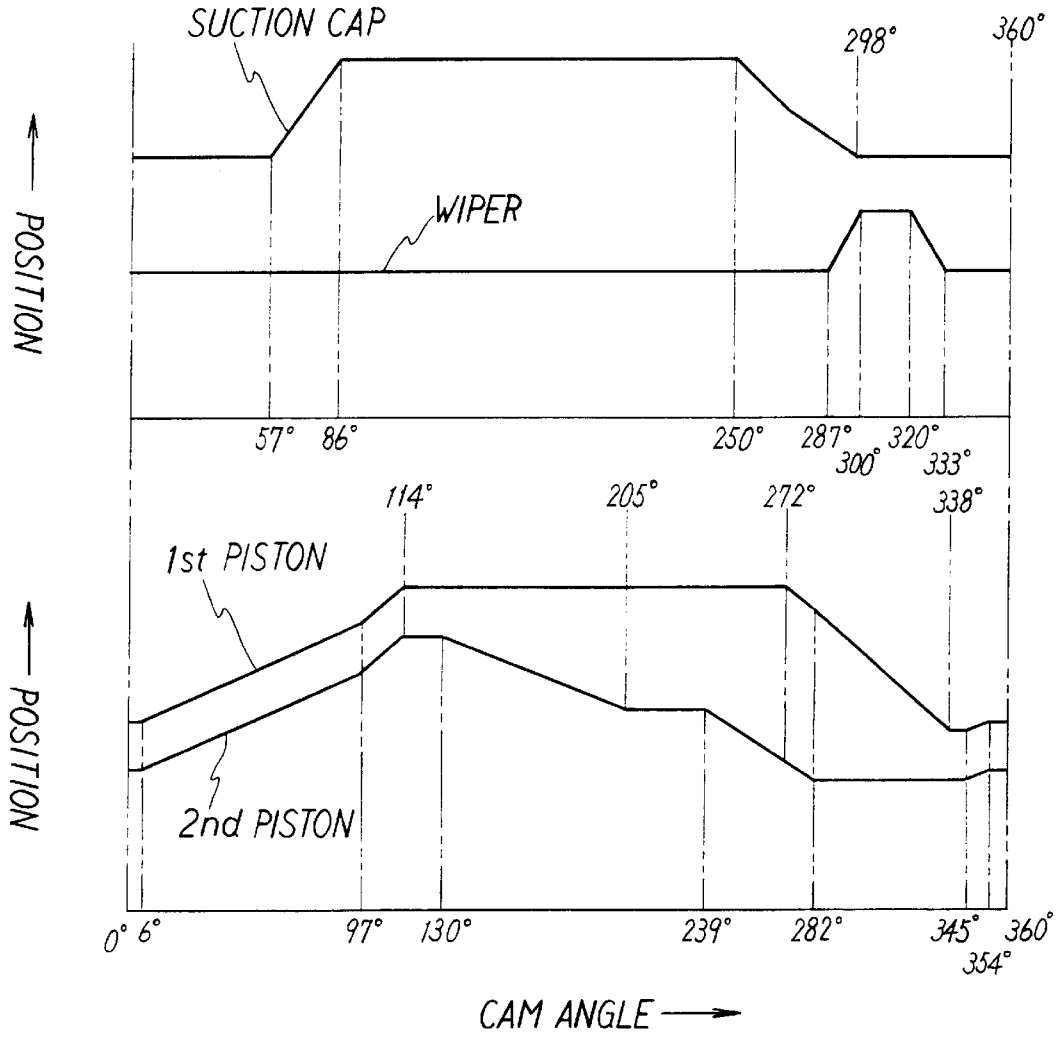
FIG. 10 is a chart of the relationship among the turning angle of the cam and the movements or actions of the suction cap, the wiper and the pump in accordance with the second embodiment.

In the meantime, when the cam 43 reaches about 57 degrees, as shown in FIG. 10, while the pistons 53 and 54 are moving backward, the suction cap 41 starts to move gradually forward from its standby position to the path of movement of the recording head 5. At about 86 degrees, the cap 41 starts to cap the nozzle formed surface of the head 5.

Figure 9C:
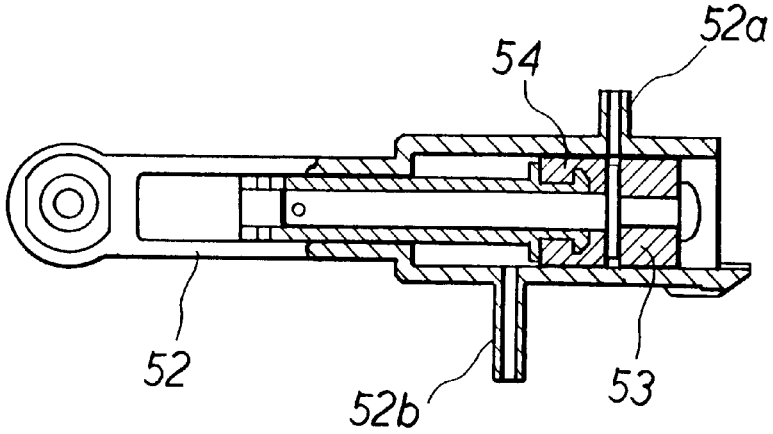
Figure 9D:
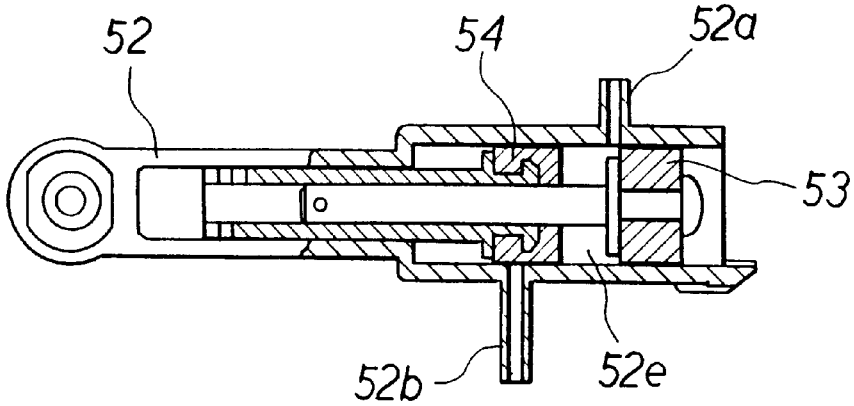
Figure 9E:
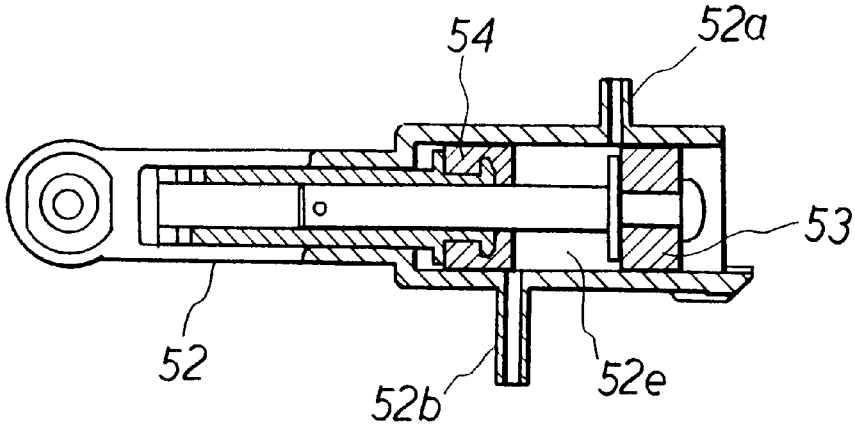

After the suction cap 41 caps the head nozzle formed surface completely, the pistons 53 and 54 are kept in their positions of FIG. 9C while the cam 43 is turning from 114 through 130 degrees. From 130 through 205 degrees, while the first piston 53 is stopping, the second piston 54 moves back away from the first piston (FIG. 9D). This enlarges the pump chamber 52*e* to suck ink.

During this suction action, the suction force is controlled by the piston 54 being driven continuously and intermittently, or intermittently at different cycle periods (frequencies). Specifically, the piston 54 may move intermittently by a constant stroke at a constant cycle period to control the pump chamber 52*e* so that the chamber volume is finally a target value. The piston 54 moves at a lower speed during automatic maintenance than during a purge for recovery from defective ejection of ink. The piston 54 moves even more slowly after cartridge replacement than during automatic maintenance.

As stated above, the pistons 53 and 54 are associated with the cam 43, which is included in the purge mechanism RM. This mechanism RM can be driven through the switching mechanism 121 by the LF motor 14, which is associated with the CPU 100 as a controller. When the cam 43 turns and halts, the piston 54 moves and halts. The CPU 100 includes another timer (not shown), which can vary the halt(ing) time to change the form of ink suction, depending on the conditions of the nozzles in the recording head 5 and the ink passages. More specifically, while the cam 43 is turning from 130 through 205 degrees, with the pump chamber 52*e* communicating with the suction port 52*a,* the piston 54 may be driven selectively at different speeds to suck ink. This can vary the maximum negative pressure for suction, with the amount of ink suction maintained, to change the form of ink suction depending on the conditions of the nozzles in the head 5 and the ink passages.

Figure 11A:
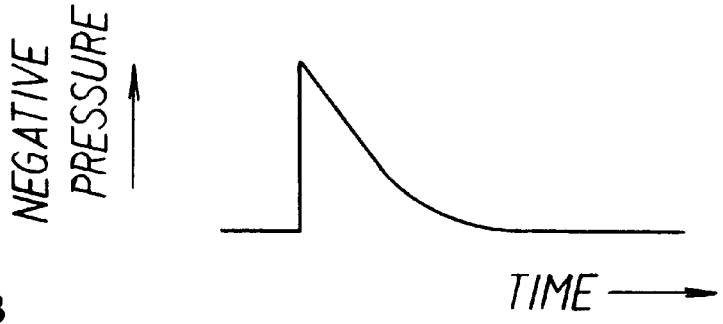
FIGS. 11A–11E are charts of the changes in the negative pressure for suction developed by the suction apparatus in accordance with the second embodiment.
Figure 11B:
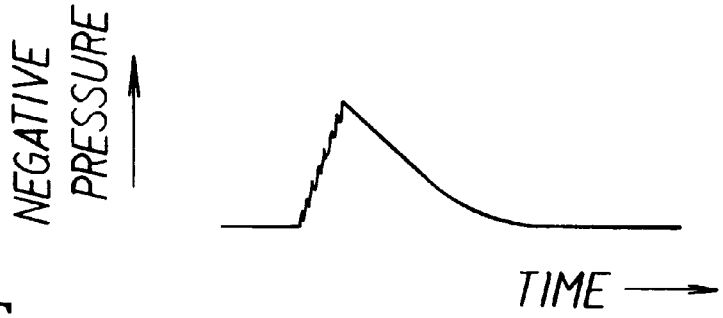
Figure 11C:
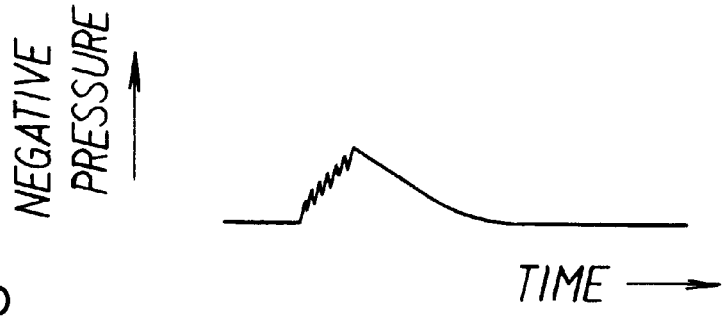
Figure 11D:
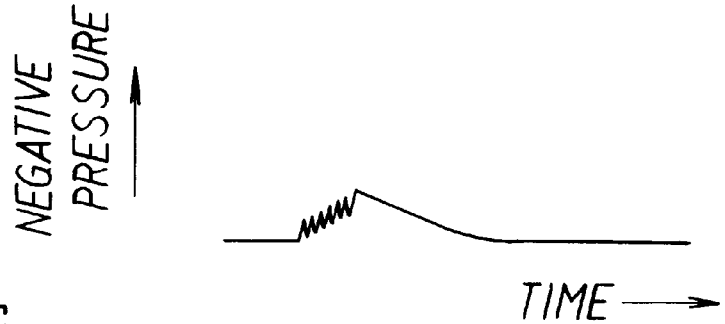
Figure 11E:
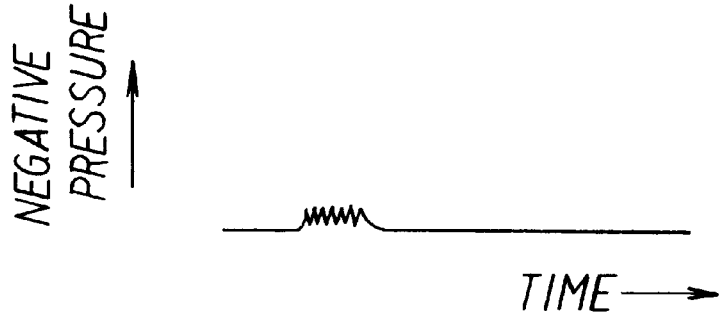

For example, during a normal purge, as shown in FIG. 11A, the second piston 54 moves, without the cam 43 halting, to enlarge the pump chamber 52*e*. This heightens the maximum negative pressure for suction to suck ink with great suction force at a dash. During automatic maintenance, as shown in FIGS. 11B–11D, the cam 43 turns intermittently by 10 degrees at a time at intervals of 50, 100 or 200 milliseconds. This makes the maximum negative pressure a little lower than during a purge so as to suck ink with slightly smaller suction force. The suction actions shown in FIGS. 11B–11D can be performed selectively depending on the length of the nonuse of the printer. After each cartridge 7 is replaced, as shown in FIG. 11E, the cam 43 turns intermittently by 10 degrees at a time at intervals of 300 milliseconds. This sucks ink gradually with even smaller suction force, without making the maximum negative pressure very high.

During automatic maintenance or after cartridge replacement, ink is sucked with the maximum negative pressure for suction lower than during a normal purge, for the following reason. After each cartridge 7 is replaced with a new one, the ink passage between the new cartridge and the recording head 5 is probably filled with air. In such a case, if the pump 42 applied great suction force through the suction cap 41 to suck ink from the new cartridge at a dash, as is the case with a normal purge, a mixture of ink and air might flow rapidly into the head 5. The rapidly flowing ink might bubble, and consequently the ink in the head 5 might contain air bubbles. This tendency is made remarkable by the filter 19 fitted between the head 5 and the cartridge 7 to keep foreign substances from moving together with ink toward the head. Therefore, by sucking ink gradually with small suction force as shown in FIG. 11E, it is possible to cause the sucked ink to flow slowly through the filter 19 and the ink passage. This can restrain the ink from bubbling, and consequently fill the recording head 5 with ink containing no air.

During automatic maintenance, the ink passage between each cartridge 7 and the recording head 5 is filled with ink. Therefore, no ink bubbles even with somewhat great suction force. In this case, however, because ink is drying, even slightly small suction force as mentioned above is sufficient to remove the ink concentrated a little. While the cam 43 is turning from 205 through 239 degrees, the pistons 53 and 54 stop. From 239 through 272 degrees, while the first piston 53 is stopping and the pump chamber 52*e* is communicating with the suction port 52*a,* the second piston 54 moves away from the first piston to the position shown in FIG. 9E, where the rear end of the second piston 54 closes the discharge port 52*b*. This sucks ink while making the chamber 52*e* larger. In the meantime, at 250 degrees, the suction cap 41 starts to leave the recording head 5 and be exposed to the atmosphere. This suction action sucks the ink remaining in the cap 41 and the suction pipe 55.

Figure 9F:
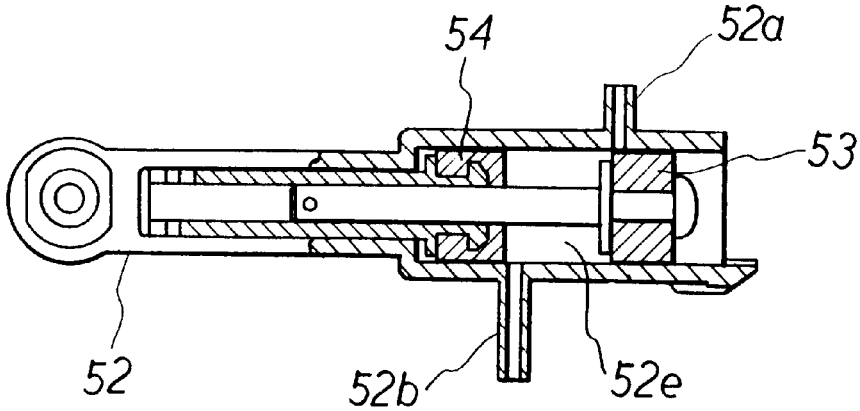
Figure 9G:
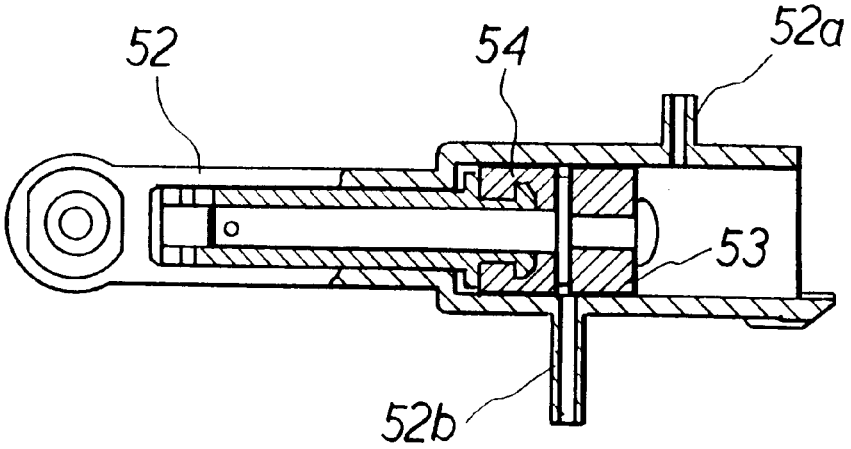
Figure 9H:
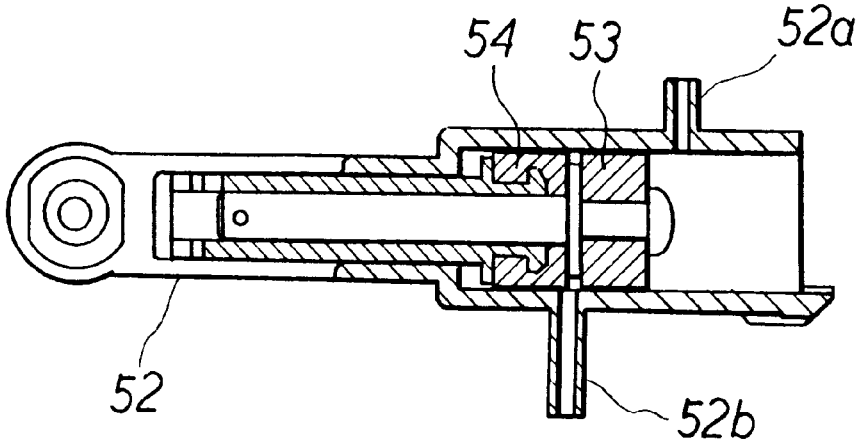

While the cam 43 is turning from 272 through 282 degrees, the first piston 53 moves forward and closes the suction port 52*a* (FIG. 9F). At the same time, the second piston 54 keeps moving forward. At about 282 degrees, as shown in FIG. 9F, the second piston 54 stops in its position where it makes the pump chamber 52*e* communicate with the discharge port 52*b*. Until about 338 degrees, the first piston 53 keeps moving forward (FIG. 9G), contracting the chamber 52*e* to discharge ink positively out of it into the waste ink tank 58.

While the cam 43 is turning from 338 through 345 degrees after the ink is discharged, both pistons 53 and 54 stop. From 345 through 354 degrees, the pistons 53 and 54 move together slightly backward to their positions shown in FIG. 9H, where they are in their substantially initial condition. This condition is maintained from 354 through 360 (0) degrees, and then the pump 52 returns to its initial condition.

In the meantime, while the cam 43 is turning from 0 through 287 degrees, the wiper 32 stands by. From 287 degrees, the wiper 32 moves forward gradually until it reaches its protruding position at 300 degrees. From 300 through 320 degrees, the wiper 32 keeps protruding in this position, where it wipes the nozzle formed surface of the recording head 5 moving toward the recording area (FIG. 10). From 320 through 333 degrees, the wiper 32 moves back gradually. From 333 through 360 degrees, the wiper 32 is kept in its standby position. In accordance with this embodiment, a single recovery process involves only one turn of the cam 43. Otherwise, a single recovery process may involve two or more turns of the cam 43. In other words, for securer recovery, the cam 43 may turn continuously by two or more turns to repeat the suction action. After each cartridge 7 is replaced, the suction action of FIG. 11E may be repeated. For the second time and later, however, because the associated ink passage is filled with ink, the suction action may be repeated with greater suction force. This can securely fill the recording head 5 with ink. The pump 52 sucks ink by the second piston 54 moving intermittently by a constant stroke at a time at a predetermined cycle period (frequency). Otherwise, one or both of the pistons 53 and 54 may move in this manner, or continuously at low speed.

It is essential for the suction apparatus of this embodiment to include at least one piston which can move in the cylinder body, and which can be driven by the controller selectively at different speeds during a suction action with the apparatus sucking ink from the recording head while the suction cap is in close contact with the head nozzle formed surface.

Third Embodiment

An ink jet printer according to the third embodiment is substantially identical with the printers of the first and second embodiments, and equivalent parts are assigned the same reference numerals. The cam grooves 43*c* and 43*d* (FIG. 3) of this embodiment are formed differently from the counterparts of those embodiments.

With reference to FIGS. 12A–12J, 13, 14A and 14B, the contact of the suction cap 41 and the wiper 32 with the recording head 5, the disengagement of them from it, and the suction and the discharge by means of the suction pump 42 in accordance with the third embodiment will be described below along the change in the turning angle of the cam 43.

Figure 12A:
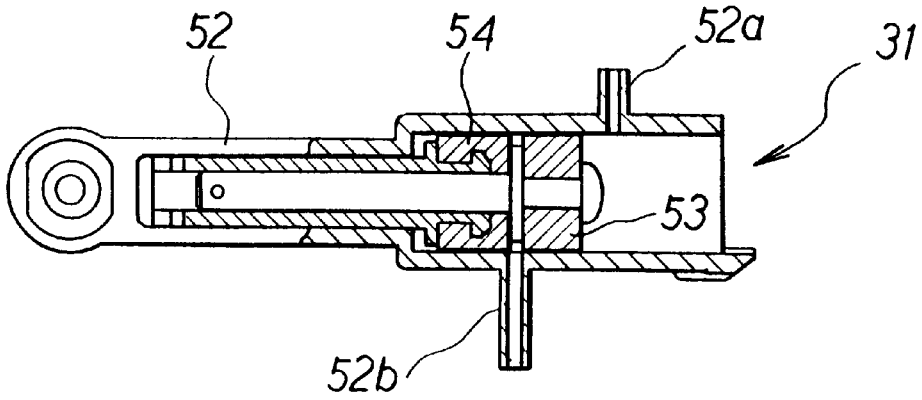
FIGS. 12A–12J are horizontal cross sections of the pump, showing the pump operation according to a third embodiment.
Figure 12B:
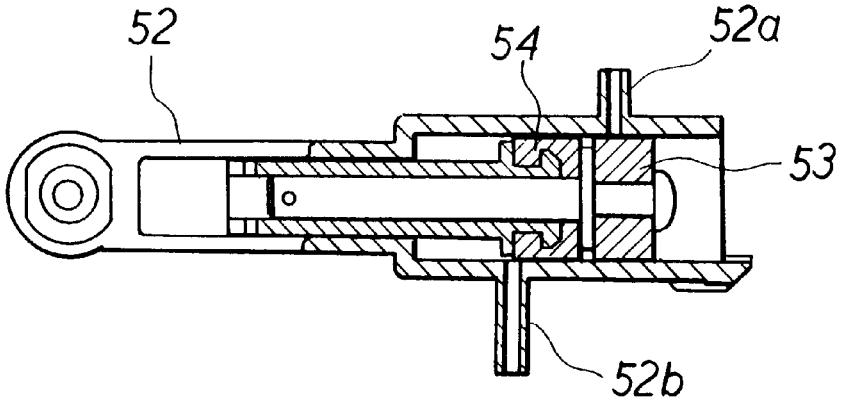

With reference first to FIG. 12A, when the turning angle of the cam 43 is around 0 degree, the pump chamber 52*e* between the pistons 53 and 54 is smallest in volume, and positioned near the discharge port 52*b*. In the meantime, the suction cap 41 is in its initial condition, in which it is at its standby position.

While the cam 43 is turning from about 6 degrees, the pistons 53 and 54 move gradually backward together. At about 97 degrees (FIG. 12B), the pistons 53 and 54 accelerate a little. At about 114 degrees, the pistons 53 and 54 stop, and the pump chamber 52*e* is positioned near the suction port 52*a* (FIG. 12C).

Figure 13:
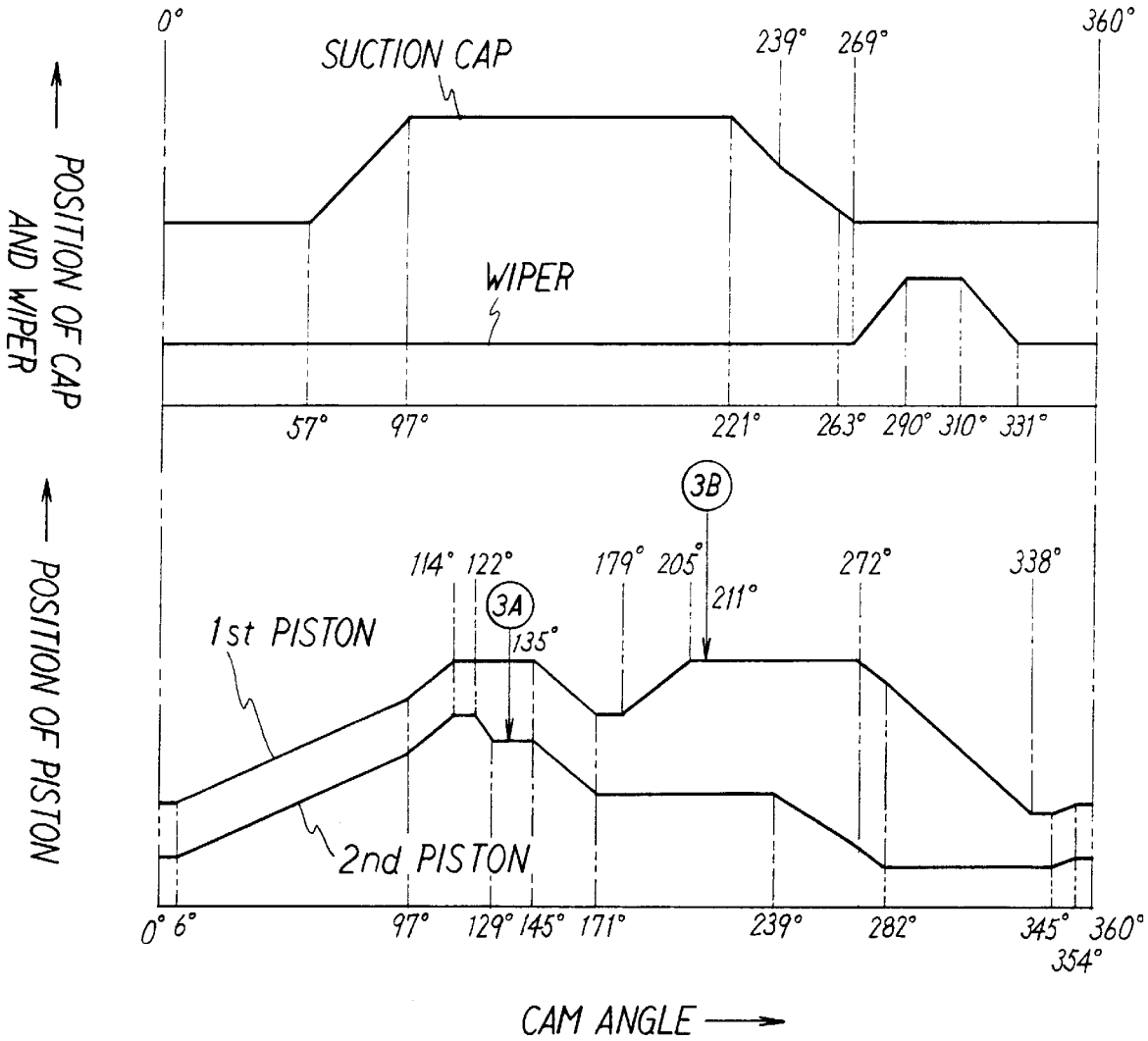
FIG. 13 is a chart of the relationship among the turning angle of the cam and the movements or actions of the suction cap, the wiper and the pump in accordance with the third embodiment.

In the meantime, when the cam 43 reaches about 57 degrees while the pistons 53 and 54 are moving, as shown in FIG. 13, the suction cap 41 starts to move forward from its standby position gradually toward the path of movement of the recording head 5. At about 97 degrees, the cap 41 starts to cap the nozzle formed surface of the head 5.

Figure 12C:
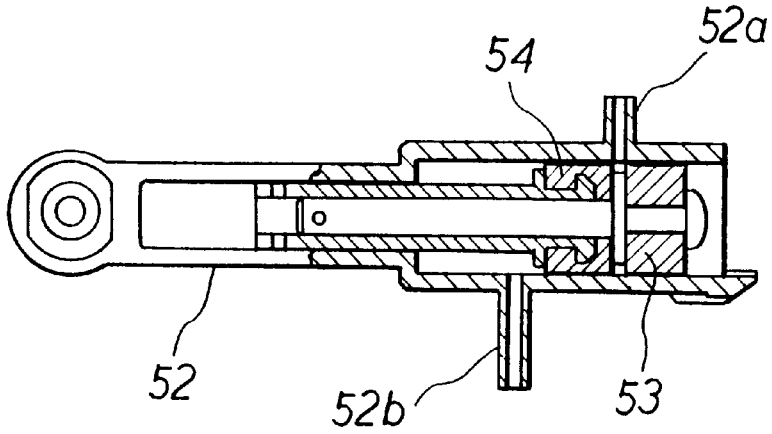
Figure 12D:
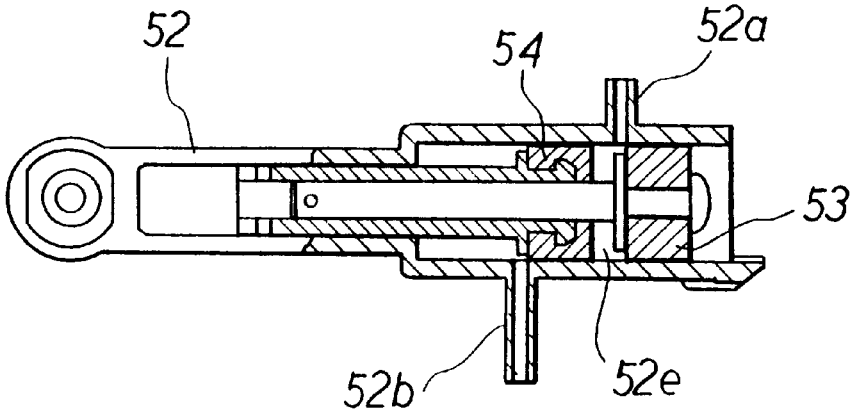

While the cam 43 is turning from 114 through 122 degrees after the suction cap 41 caps the head nozzle formed surface completely, the pistons 53 and 54 keep stopping at their positions of FIG. 12C. From 122 through 129 degrees, while the first piston 53 is stopping, the second piston 54 moves away from the first piston (FIG. 12D). This enlarges the pump chamber 52*e* and makes it communicate with the suction port 52*a* to start the first suction action. From 129 through 145 degrees, both pistons 53 and 54 stop.

If each cartridge 7 is replaced, the associated detection switch 21 sends a signal to the CPU 100. In response to the signal, when the cam 43 reaches about 136 degrees (position 3A in FIG. 13), the CPU 100 interrupts the energization of the LF motor 14 for about three seconds to stop the cam 43. As a result, the first suction action ("a" in FIG. 14A) is performed for about three seconds. The amount of ink sucked by this first action may be such that ink can flow from the cartridge 7 through the associated filter 19 into the manifold 15.

Figure 12E:
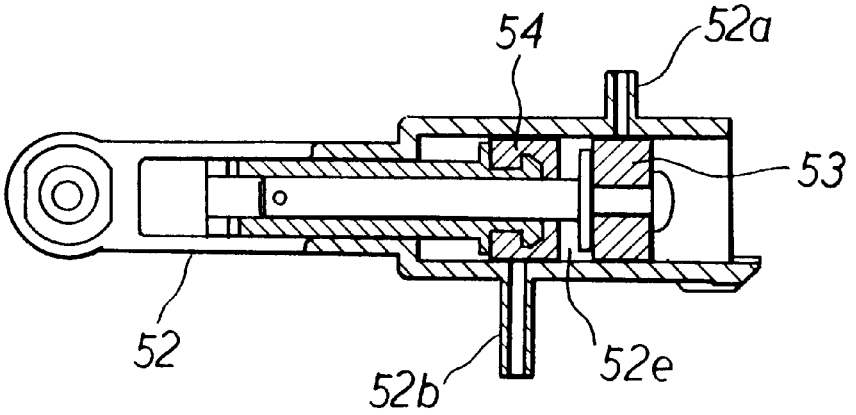

On the other hand, for ink suction not after cartridge replacement, the cam 43 does not stop at the position 3A, but turns from 122 through 145 degrees in about 0.225 second. This makes the first piston 53 close the suction port 52*a* immediately (FIG. 12E). Consequently, as shown in FIG. 14B, the first suction action "a" appears for an instant, but no substantial suction action is performed. Substantially, the first action "a" vanishes.

While the cam 43 is turning from 145 through 171 degrees, with the volume of the pump chamber 52*e* maintained, as shown in FIG. 12E, the pistons 53 and 54 move forward, and the first piston 53 closes the suction port 52*a*. In the meantime, the second piston 54 closes the discharge port 52*b*.

Figure 12F:
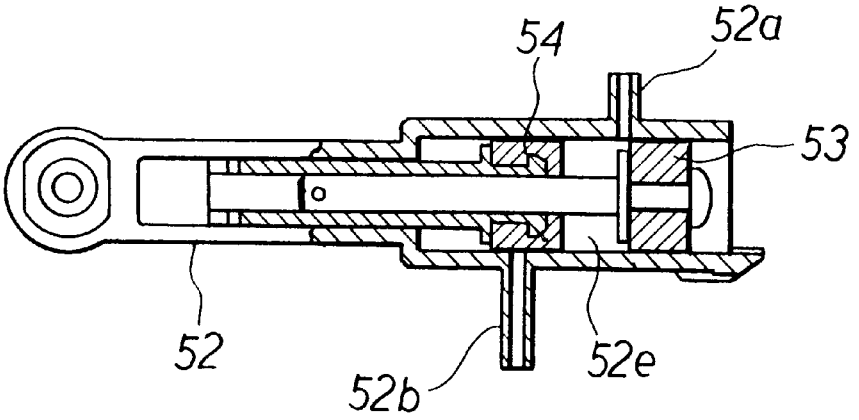
Figure 12G:
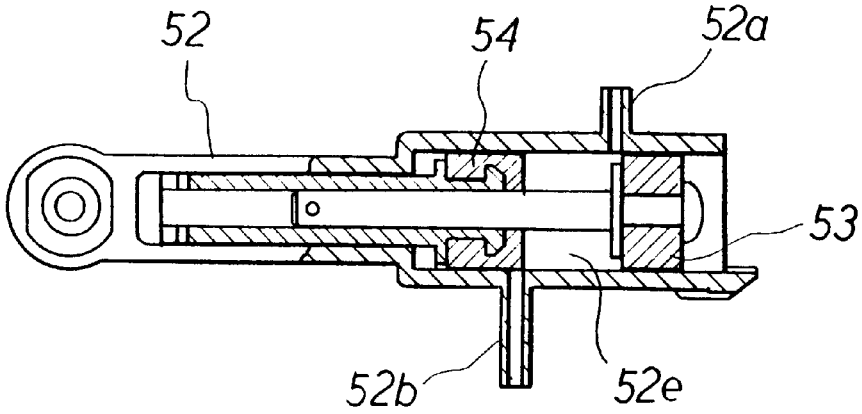

While the cam 43 is turning from 171 through 179 degrees, the pistons 53 and 54 stop. From 179 through 205 degrees, with the second piston 54 stopping and closing the discharge port 52*b*, as shown in FIG. 12F, the first piston 53 moves away from the second piston. This enlarges the chamber 52*e* to heighten the negative pressure in it. At 205 degrees, the first piston 53 stops with the chamber 52*e* communicating with the suction port 52*a*. From 205 through about 239 degrees, with this communication maintained, both pistons 53 and 54 stop.

When the cam 43 reaches about 211 degrees (position 3B in FIG. 13), it stops for five seconds. This performs the second suction action "b" (FIGS. 14A and 14B), which is greater in suction force and longer in suction time than the first action "a". The amount of ink sucked by the second action "b" is larger than the amount of new ink for filling the associated channels in the recording head 5, and is sufficient to restore the head 5 to its good condition of ejection.

When the cam 43 reaches 221 degrees, the suction cap 41 starts to leave the recording head 5. In the meantime, from 239 through 272 degrees, with the first piston 53 stopping and the pump chamber 52*e* communicating with the suction port 52*a,* the second piston 54 moves away from the first piston to the position of FIG. 12G, where its rear end closes the discharge port 52*b*. This performs a suction action while making the chamber 52*e* larger. This action sucks, together with air, the ink remaining in the suction cap 41 and the suction pipe 55.

Figure 12H:
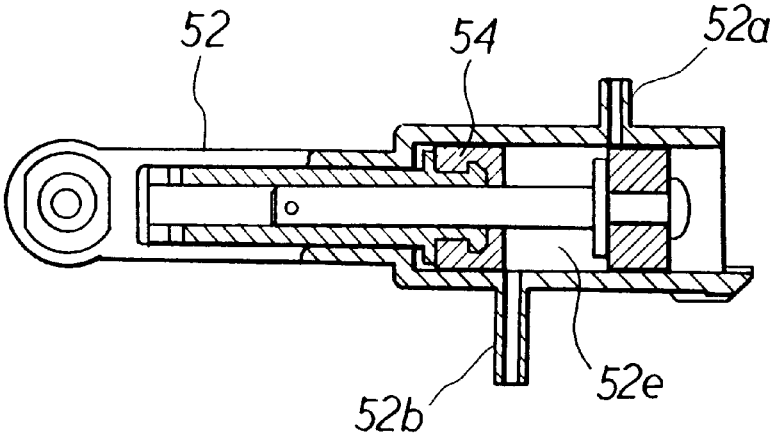
Figure 12I:
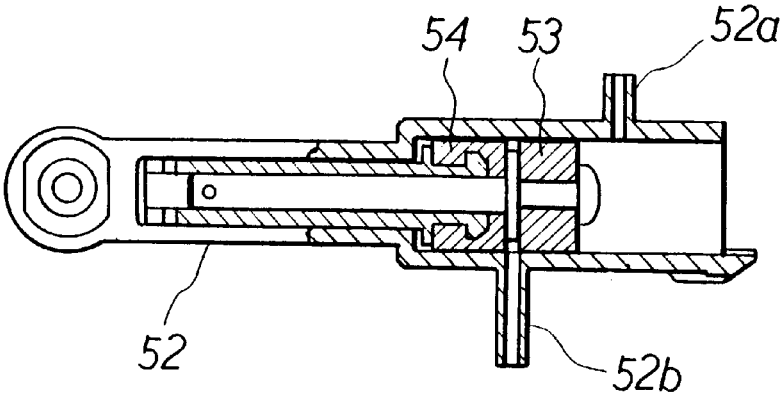
Figure 12J:
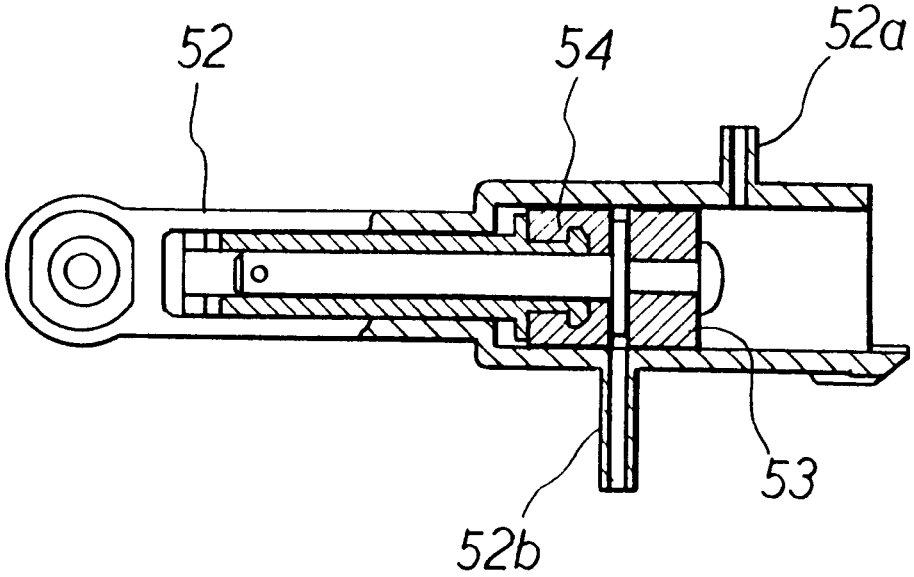

While the cam 43 is turning from 272 through 282 degrees, as shown in FIG. 12H, the second piston 54 keeps moving forward. At the same time, the first piston 53 moves forward and closes the suction port 52*a*. The second piston 54 moves until the pump chamber 52*e* communicates with the discharge port 52*b*. At about 282 degrees, the second piston 54 stops. In the meantime, until about 338 degrees, the first piston 53 keeps moving, contracting the chamber 52*e* to perform a positive discharge action (FIG. 12I). This discharges ink from the chamber 52*e* into the waste ink tank 58.

While the cam 43 is turning from 338 through 345 degrees after the ink is discharged, both pistons 53 and 54 stop. From 345 through 354 degrees, the pistons 53 and 54 move a little back to their positions shown in FIG. 12J, where the pump 42 is in its substantially initial condition. This condition is maintained from 354 through 360 (0) degrees. Then, the pump 42 returns to its initial condition.

While the cam 43 is turning from 0 through 269 degrees, the wiper 32 stands by. From 269 through 290 degrees, the wiper 32 protrudes gradually. At 290 degrees, the wiper 32 reaches its protruding position. From 290 through 310 degrees, the wiper 32 keeps protruding at this position, where it wipes the nozzle formed surface of the recording head 5 moving toward the recording area (FIG. 13). From 310 through 331 degrees, the wiper 32 retracts gradually toward its standby position. From 331 through 360 degrees, the wiper 32 stands by at this position.

After the wiper 32 wipes the nozzle formed surface of the recording head 5, the head moves to the flushing area, where ink is ejected preliminarily from all the nozzles of the head 5 into the waste ink receiver 22. Then, the head 5 moves to its recording start position.

The control of the pump 42 by means of the cam 43 involves the two different suction actions differing in suction force for sucking ink from the recording head 5. One of the actions is the first suction action which is smaller in suction force. The other action is the second suction action which is greater in suction force and longer in suction time. The two actions are performed for the following reason.

In some cases, the recording head 5 contains no ink, and the ink passage between the head 5 and each cartridge 7 is filled with air. In such cases, if the pump 42 applied high negative pressure through the suction cap 41 to suck ink from the head 5 at a dash, a mixture of ink and air would flow rapidly from the cartridge 7 into the head 5. The rapidly flowing ink would bubble, and consequently the ink in the ejection channels of the head 5 would contain air bubbles.

The first suction action causes ink to flow into the passage while expelling the air in it. The subsequent second action fills ink into the recording head 5. This maintains a good condition of ejection without ink bubbling. The tendency to bubble is made remarkable by the filter 19 fitted between the head 5 and the cartridge 7 to keep foreign substances etc. from moving together with ink toward the head as stated above. Therefore, the two actions are effective in particular for this embodiment.

Depending on purposes, two or more series of actions including the first and second suction actions may be performed. For example, after each cartridge 7 is replaced, six series of such actions are performed continuously for the associated portion of the recording head 5. The first series includes the first and second actions to introduce ink into the head 5 without the ink bubbling as stated above. From the second through sixth series, the first action is caused to vanish, and only the second action is repeated, because no ink bubbles. This securely fills the head 5 with new ink to make the head ready for ejection.

The actions for ejection recovery or restoration may be performed either properly by the user's keying as stated above, or automatically by the printer being based on a timing action. For the automatic actions, it is possible to decide the number of repetitions of only the second suction action (with the first action caused to vanish), depending on the length of the measured time. In this case, by making the first action vanish, it is possible to save the ink and time which would otherwise be consumed by this action.

Although the invention has been described in specific embodiments 1–3, the invention may be embodied in other specific forms without departing from the sprit or essential characteristics thereof. The suction pump of this embodiment is a piston pump, but might be replaced by a tube type pump which comprises a roller and a tube connected between the suction cap and the roller. The pump can develop negative pressure with the restoring force of its tube squashed by a roller.

What is claimed is:

1. An ink jet printer comprising:

an ink jet head having nozzles for ejecting ink;

a suction cap for covering the nozzles;

a pump for sucking ink out of the head through the suction cap to purge the head; and a controller controlling the pump depending on the condition of the printer when a purge is performed, to adjust at least one of a suction cycle period and a suction pressure applied to the suction cap, wherein, the controller controls the pump in such a manner that at least one of the automatic purges at predetermined time intervals for the maintenance of the printer, a manual purge for recovery from defective ejection of ink from the ink jet head and a purge just after the replacement of an ink cartridge for the printer differ from each other in at least one of the suction cycle period and the suction pressure, and wherein, the controller controls the pump in such a manner that the suction pressure is lower for the purge just after cartridge replacement than for the automatic purges, and the suction pressure is lower for the purge just after cartridge replacement than for the manual purge.

2. The ink jet printer defined in claim 1, wherein the controller controls the pump in such a manner that at least one of the automatic purges at predetermined time intervals for the maintenance of the printer, a manual purge for recovery from defective ejection of ink from the ink jet head and a purge just after the replacement of an ink cartridge for the printer differ from each other in at least one of the suction cycle period and the suction pressure.

3. The ink jet printer defined in claim 2, wherein the controller controls the pump in such a manner that the suction pressure is lower for the automatic purges than for the manual purge, and that the suction pressure is lower for the purge just after cartridge replacement than for the automatic purges.

4. The ink jet printer defined in claim 2, wherein the pump can perform a first suction action and a second suction action, which is greater in suction force and longer in suction time than the first action, the first action being omitted during each of the automatic and manual purges.

5. The ink jet printer defined in claim 2, wherein the pump performs a suction action with smaller suction force for a shorter time for the purge just after cartridge replacement than for the manual and automatic purges.

6. The ink jet printer defined in claim 2, wherein the pump performs, for the purge just after cartridge replacement, a plurality of suction actions with small suction force each for a short time and, thereafter, a suction action with great suction force for a long time.

7. The ink jet printer defined in claim 1, and further comprising a memory storing various suction modes, which are combinations of suction pressures and suction cycle periods, the controller selecting the suction mode depending on the printer condition when the purge is performed, the controller operating the pump in accordance with the selected mode.

8. The ink jet printer defined in claim 7, and further comprising a switch for performing the operator's manual purge, the suction modes including a mode of performing the manual purge on the basis of the operator's switching operation.

9. The ink jet printer defined in claim 7, and further comprising a timer, the suction modes including a mode of performing automatic purges at time intervals predetermined by the timer.

10. The ink jet printer defined in claim 7, and further comprising a sensor for detecting the replacement of an ink cartridge, the suction modes including a mode of performing a purge just after replacement of an ink cartridge in accordance with a detection signal from the sensor.

11. The ink jet printer defined in claim 1, wherein the pump includes: a pump body having a suction port and a discharge port; and a pair of pistons which can slide in the body, the pistons defining a pump chamber therebetween in the body, at least one of the pistons being able to close and open at least one of the ports when the one of the pistons slides;

the printer further comprising a cam connected to the pistons to drive the pistons.

12. The ink jet printer defined in claim 11, wherein at least one of the suction pressure and the suction cycle period is adjusted by controlling the slides of the pistons.

13. The ink jet printer defined in claim 12, wherein at least one of the suction pressure and the suction cycle period is adjusted by moving the pistons continuously or intermittently with the suction port being open.

14. The ink jet printer defined in claim 13, wherein at least one of the suction pressure and the suction cycle period is adjusted by varying the cycle period at which the pistons move intermittently.

15. The ink jet printer defined in claim 13, wherein at least one of the suction pressure and the suction cycle period is adjusted by adjusting the time for which the pistons stop with the suction port being open.

16. The ink jet printer defined in claim 11, wherein the cam has cam grooves of predetermined patterns, the printer further comprising cam followers each connected to one of the pistons and each engaging with one of the grooves.

17. The ink jet printer defined in claim 16, wherein the suction port is opened a plurality of times during one turn of the cam, at least one of the suction pressure and the suction cycle period being adjusted by turning the cam continuously or intermittently while the suction port is open.

18. The ink jet printer defined in claim 16, further comprising a sensor for detecting the turning angle of the cam, the controller controlling the turning of the cam depending on the turning angle detected by the sensor.

19. The ink jet printer defined in claim 16, wherein the turning speed of the cam is constant.

20. The ink jet printer defined in claim 16, wherein various suction modes are produced by adjusting the turning speed of the cam by adjusting a drive driving the cam under the control of the controller.

21. The ink jet printer defined in claim 16, further comprising a drive driving the cam, the controller controlling the drive.

22. The ink jet printer defined in claim 11, further comprising a memory storing various suction modes, which are combinations of suction pressures and suction cycle periods, the controller selecting the suction mode depending on the printer condition when the purge is performed, the controller causing the pump to operate in accordance with the selected mode.

23. The ink jet printer defined in claim 22, further comprising a switch for performing the operator's manual purge, the suction modes including a mode of performing the manual purge on the basis of the operator's switching operation.

24. The ink jet printer defined in claim 22, further comprising a timer, the suction modes including a mode of performing automatic purges at time intervals predetermined by the timer.

25. The ink jet printer defined in claim 22, further comprising a sensor for detecting the replacement of an ink cartridge, the suction modes including a mode of performing in accordance with a detection signal from the sensor a purge just after an ink cartridge is replaced.

26. The ink jet printer defined in claim 1, and further comprising:

a wiper wiping the ink jet head; and a capping device for keeping the nozzles from drying.

27. The ink jet printer defined in claim 11, wherein the suction cap includes a member having a cam follower in engagement with the cam.

* * * * *